US009799298B2

(12) United States Patent
Hayakawa et al.

(10) Patent No.: US 9,799,298 B2
(45) Date of Patent: Oct. 24, 2017

(54) LIQUID CRYSTAL DISPLAY DEVICE AND DRIVING METHOD THEREOF

(75) Inventors: Masahiko Hayakawa, Kanagawa (JP); Shinya Okano, Kanagawa (JP)

(73) Assignee: Semiconductor Energy Laboratory Co., Ltd., Atsugi-shi, Kanagawa-ken (JP)

( * ) Notice: Subject to any disclaimer, the term of this patent is extended or adjusted under 35 U.S.C. 154(b) by 64 days.

(21) Appl. No.: 13/092,191

(22) Filed: Apr. 22, 2011

(65) Prior Publication Data

US 2011/0261043 A1 Oct. 27, 2011

(30) Foreign Application Priority Data

Apr. 23, 2010 (JP) ..... 2010-100365

(51) Int. Cl.
*G09G 3/36* (2006.01)

(52) U.S. Cl.
CPC ..... *G09G 3/3696* (2013.01); *G09G 2330/021* (2013.01)

(58) Field of Classification Search
CPC ..... G09G 3/3696; G09G 2330/021
USPC ..... 345/87–104, 211
See application file for complete search history.

(56) References Cited

U.S. PATENT DOCUMENTS 5,107,354 A 4/1992 Yamazaki et al.
5,181,131 A 1/1993 Yamazaki et al.
5,731,856 A 3/1998 Kim et al.
5,744,864 A 4/1998 Cillessen et al.
5,877,533 A 3/1999 Arai et al.
6,294,274 B1 9/2001 Kawazoe et al.
6,563,174 B2 5/2003 Kawasaki et al.
6,727,522 B1 4/2004 Kawasaki et al.
6,795,066 B2 9/2004 Tanaka et al.
6,850,080 B2 2/2005 Hiroki
7,049,190 B2 5/2006 Takeda et al.
7,061,014 B2 6/2006 Hosono et al.
7,064,346 B2 6/2006 Kawasaki et al.
7,105,868 B2 9/2006 Nause et al.
7,196,701 B2 3/2007 Tsutsui et al.
7,211,825 B2 5/2007 Shih et al
(Continued)

FOREIGN PATENT DOCUMENTS

CN 1339934 A 3/2002
CN 101071311 A 11/2007
(Continued)

OTHER PUBLICATIONS

Kazuhiko Tsuda et al; "Ultra low power consumption technologies for mobile TFT-LCDs"; IDW '02; Dec. 4, 2002; pp. 295-298.
(Continued)

*Primary Examiner* — Lisa Landis
(74) *Attorney, Agent, or Firm* — Fish & Richardson P.C.

(57) ABSTRACT

A display device in which power consumed in an image holding period is suppressed. The display device includes a liquid crystal display panel which is driven by power supplied from a converter or a backup circuit. A fixed potential may be supplied and a capacitor may be charged with the use of the converter in a writing operation where a load is large, and the fixed potential may be preferentially supplied from the capacitor without using the converter in an image holding period when the load is small.

22 Claims, 12 Drawing Sheets

(56) References Cited

U.S. PATENT DOCUMENTS

| | | | | |
|---|---|---|---|---|
| 7,282,782 | B2 | 10/2007 | Hoffman et al. | |
| 7,286,108 | B2 | 10/2007 | Tsuda et al. | |
| 7,297,977 | B2 | 11/2007 | Hoffman et al. | |
| 7,321,353 | B2 | 1/2008 | Tsuda et al. | |
| 7,323,356 | B2 | 1/2008 | Hosono et al. | |
| 7,385,224 | B2 | 6/2008 | Ishii et al. | |
| 7,402,506 | B2 | 7/2008 | Levy et al. | |
| 7,411,209 | B2 | 8/2008 | Endo et al. | |
| 7,453,065 | B2 | 11/2008 | Saito et al. | |
| 7,453,087 | B2 | 11/2008 | Iwasaki | |
| 7,462,862 | B2 | 12/2008 | Hoffman et al. | |
| 7,468,304 | B2 | 12/2008 | Kaji et al. | |
| 7,501,293 | B2 | 3/2009 | Ito et al. | |
| 7,674,650 | B2 | 3/2010 | Akimoto et al. | |
| 7,675,239 | B2 | 3/2010 | Marhefka et al. | |
| 7,714,535 | B2 | 5/2010 | Yamazaki et al. | |
| 7,732,819 | B2 | 6/2010 | Akimoto et al. | |
| 7,750,886 | B2 | 7/2010 | Sampsell | |
| 7,812,806 | B2 | 10/2010 | Koyama et al. | |
| 7,852,303 | B2 | 12/2010 | Hashimoto | |
| 7,852,311 | B2 | 12/2010 | Hashimoto | |
| 7,859,242 | B2 | 12/2010 | Kawagishi et al. | |
| 7,864,546 | B2 | 1/2011 | Dhuyvetter et al. | |
| 7,893,892 | B2 | 2/2011 | Tamura et al. | |
| 7,907,042 | B2 | 3/2011 | Kawasaki et al. | |
| 7,911,544 | B2 | 3/2011 | Nobori et al. | |
| 7,924,276 | B2 | 4/2011 | Tsuda et al. | |
| 8,013,831 | B2 | 9/2011 | Sampsell | |
| 8,049,225 | B2 | 11/2011 | Yamazaki et al. | |
| 8,089,573 | B2 | 1/2012 | Matsuda et al. | |
| 8,193,045 | B2 | 6/2012 | Omura et al. | |
| 8,411,026 | B2 | 4/2013 | Sampsell | |
| 8,749,462 | B2 | 6/2014 | Eom | |
| 8,785,240 | B2 | 7/2014 | Watanabe | |
| 8,785,242 | B2 | 7/2014 | Yamazaki et al. | |
| 9,105,659 | B2 | 8/2015 | Yamazaki et al. | |
| 9,153,703 | B2 | 10/2015 | Kaji et al. | |
| 2001/0046027 | A1 | 11/2001 | Tai et al. | |
| 2002/0036636 | A1* | 3/2002 | Yanagi et al. | 345/211 |
| 2002/0056838 | A1 | 5/2002 | Ogawa | |
| 2002/0132454 | A1 | 9/2002 | Ohtsu et al. | |
| 2003/0189401 | A1 | 10/2003 | Kido et al. | |
| 2003/0218222 | A1 | 11/2003 | Wager, III et al. | |
| 2004/0038446 | A1 | 2/2004 | Takeda et al. | |
| 2004/0127038 | A1 | 7/2004 | Carcia et al. | |
| 2005/0017302 | A1 | 1/2005 | Hoffman | |
| 2005/0199959 | A1 | 9/2005 | Chiang et al. | |
| 2005/0219193 | A1 | 10/2005 | Nagaoka et al. | |
| 2006/0035452 | A1 | 2/2006 | Carcia et al. | |
| 2006/0043377 | A1 | 3/2006 | Hoffman et al. | |
| 2006/0091793 | A1 | 5/2006 | Baude et al. | |
| 2006/0108529 | A1 | 5/2006 | Saito et al. | |
| 2006/0108636 | A1 | 5/2006 | Sano et al. | |
| 2006/0110867 | A1 | 5/2006 | Yabuta et al. | |
| 2006/0113536 | A1 | 6/2006 | Kumomi et al. | |
| 2006/0113539 | A1 | 6/2006 | Sano et al. | |
| 2006/0113549 | A1 | 6/2006 | Den et al. | |
| 2006/0113565 | A1 | 6/2006 | Abe et al. | |
| 2006/0169973 | A1 | 8/2006 | Isa et al. | |
| 2006/0170111 | A1 | 8/2006 | Isa et al. | |
| 2006/0197092 | A1 | 9/2006 | Hoffman et al. | |
| 2006/0208977 | A1 | 9/2006 | Kimura | |
| 2006/0228974 | A1 | 10/2006 | Thelss et al. | |
| 2006/0231882 | A1 | 10/2006 | Kim et al. | |
| 2006/0238135 | A1 | 10/2006 | Kimura | |
| 2006/0244107 | A1 | 11/2006 | Sugihara et al. | |
| 2006/0284171 | A1 | 12/2006 | Levy et al. | |
| 2006/0284172 | A1 | 12/2006 | Ishii | |
| 2006/0292777 | A1 | 12/2006 | Dunbar | |
| 2007/0024187 | A1 | 2/2007 | Shin et al. | |
| 2007/0046191 | A1 | 3/2007 | Saito | |
| 2007/0052025 | A1 | 3/2007 | Yabuta | |
| 2007/0054507 | A1 | 3/2007 | Kaji et al. | |
| 2007/0090365 | A1 | 4/2007 | Hayashi et al. | |
| 2007/0108446 | A1 | 5/2007 | Akimoto | |
| 2007/0152217 | A1 | 7/2007 | Lai et al. | |
| 2007/0172591 | A1 | 7/2007 | Seo et al. | |
| 2007/0187678 | A1 | 8/2007 | Hirao et al. | |
| 2007/0187760 | A1 | 8/2007 | Furuta et al. | |
| 2007/0194379 | A1 | 8/2007 | Hosono et al. | |
| 2007/0252928 | A1 | 11/2007 | Ito et al. | |
| 2007/0262757 | A1* | 11/2007 | Kawagoshi | 323/265 |
| 2007/0272922 | A1 | 11/2007 | Kim et al. | |
| 2007/0279350 | A1 | 12/2007 | Huang et al. | |
| 2007/0287296 | A1 | 12/2007 | Chang | |
| 2008/0006877 | A1 | 1/2008 | Mardilovich et al. | |
| 2008/0038882 | A1 | 2/2008 | Takechi et al. | |
| 2008/0038929 | A1 | 2/2008 | Chang | |
| 2008/0050595 | A1 | 2/2008 | Nakagawara et al. | |
| 2008/0073653 | A1 | 3/2008 | Iwasaki | |
| 2008/0083950 | A1 | 4/2008 | Pan et al. | |
| 2008/0106191 | A1 | 5/2008 | Kawase | |
| 2008/0128689 | A1 | 6/2008 | Lee et al. | |
| 2008/0129195 | A1 | 6/2008 | Ishizaki et al. | |
| 2008/0166834 | A1 | 7/2008 | Kim et al. | |
| 2008/0182358 | A1 | 7/2008 | Cowdery-Corvan et al. | |
| 2008/0224133 | A1 | 9/2008 | Park et al. | |
| 2008/0254569 | A1 | 10/2008 | Hoffman et al. | |
| 2008/0258139 | A1 | 10/2008 | Ito et al. | |
| 2008/0258140 | A1 | 10/2008 | Lee et al. | |
| 2008/0258141 | A1 | 10/2008 | Park et al. | |
| 2008/0258143 | A1 | 10/2008 | Kim et al. | |
| 2008/0284929 | A1* | 11/2008 | Kimura | 349/38 |
| 2008/0296568 | A1 | 12/2008 | Ryu et al. | |
| 2009/0058311 | A1* | 3/2009 | Eom | 315/173 |
| 2009/0068773 | A1 | 3/2009 | Lai et al. | |
| 2009/0073325 | A1 | 3/2009 | Kuwabara et al. | |
| 2009/0114910 | A1 | 5/2009 | Chang | |
| 2009/0134399 | A1 | 5/2009 | Sakakura et al. | |
| 2009/0152506 | A1 | 6/2009 | Umeda et al. | |
| 2009/0152541 | A1 | 6/2009 | Maekawa et al. | |
| 2009/0278122 | A1 | 11/2009 | Hosono et al. | |
| 2009/0280600 | A1 | 11/2009 | Hosono et al. | |
| 2009/0289932 | A1 | 11/2009 | Nishi | |
| 2010/0013818 | A1 | 1/2010 | Akai et al. | |
| 2010/0026619 | A1* | 2/2010 | Umezaki | 345/100 |
| 2010/0065844 | A1 | 3/2010 | Tokunaga | |
| 2010/0084654 | A1 | 4/2010 | Yamazaki et al. | |
| 2010/0092800 | A1 | 4/2010 | Itagaki et al. | |
| 2010/0109002 | A1 | 5/2010 | Itagaki et al. | |

FOREIGN PATENT DOCUMENTS

| | | | |
|---|---|---|---|
| CN | 101378229 | A | 3/2009 |
| CN | 100511399 | C | 7/2009 |
| CN | 101506865 | A | 8/2009 |
| CN | 101578551 | A | 11/2009 |
| EP | 1139330 | A | 10/2001 |
| EP | 1296174 | A | 3/2003 |
| EP | 1 376 529 | A2 | 1/2004 |
| EP | 1 180 762 | B1 | 6/2005 |
| EP | 1 737 044 | A1 | 12/2006 |
| EP | 1887555 | A | 2/2008 |
| EP | 2031941 | A | 3/2009 |
| EP | 2040114 | A | 3/2009 |
| EP | 2112550 | A | 10/2009 |
| EP | 2 226 847 | A2 | 9/2010 |
| EP | 2264518 | A | 12/2010 |
| EP | 2264519 | A | 12/2010 |
| JP | 60-198861 | A | 10/1985 |
| JP | 63-210022 | A | 8/1988 |
| JP | 63-210023 | A | 8/1988 |
| JP | 63-210024 | A | 8/1988 |
| JP | 63-215519 | A | 9/1988 |
| JP | 63-239117 | A | 10/1988 |
| JP | 63-265818 | A | 11/1988 |
| JP | 02-131219 | A | 5/1990 |
| JP | 05-251705 | A | 9/1993 |
| JP | 08-264794 | A | 10/1996 |
| JP | 09-191569 | A | 7/1997 |
| JP | 10-294135 | A | 11/1998 |
| JP | 11-505377 | A | 5/1999 |
| JP | 2000-044236 | A | 2/2000 |
| JP | 2000-150900 | A | 5/2000 |

(56) References Cited

FOREIGN PATENT DOCUMENTS

| | | | | | |
|---|---|---|---|---|---|
| JP | 2001-282164 | A | | 10/2001 | |
| JP | 2001-312253 | A | | 11/2001 | |
| JP | 2002-076356 | A | | 3/2002 | |
| JP | 2002-123234 | A | | 4/2002 | |
| JP | 2002-278523 | A | | 9/2002 | |
| JP | 2002-289859 | A | | 10/2002 | |
| JP | 2003-086000 | A | | 3/2003 | |
| JP | 2003-086808 | A | | 3/2003 | |
| JP | 2003-202844 | A | | 7/2003 | |
| JP | 2003202844 | | * | 7/2003 | |
| JP | 2003202844 | A | * | 7/2003 | ..... G09G 3/36 |
| JP | 2004-103957 | A | | 4/2004 | |
| JP | 2004-273614 | A | | 9/2004 | |
| JP | 2004-273732 | A | | 9/2004 | |
| JP | 2007-194594 | A | | 8/2007 | |
| JP | 2007-304698 | A | | 11/2007 | |
| JP | 2008-218495 | A | | 9/2008 | |
| JP | 2008-281988 | A | | 11/2008 | |
| JP | 2009-010362 | A | | 1/2009 | |
| JP | 2009-053427 | A | | 3/2009 | |
| JP | 2010-026019 | A | | 2/2010 | |
| JP | 2010-113346 | A | | 5/2010 | |
| KR | 2002-0013748 | A | | 2/2002 | |
| TW | 200627371 | | | 8/2006 | |
| TW | 200818677 | | | 4/2008 | |
| TW | 200844941 | | | 11/2008 | |
| TW | I307069 | | | 3/2009 | |
| TW | 201013934 | | | 4/2010 | |
| WO | 2004/114391 | A1 | | 12/2004 | |
| WO | WO-2006/036415 | | | 4/2006 | |
| WO | WO-2007/143544 | | | 12/2007 | |
| WO | 2008/029551 | A1 | | 3/2008 | |
| WO | WO-2008/105250 | | | 9/2008 | |
| WO | WO-2008/126879 | | | 10/2008 | |
| WO | WO-2008/149873 | | | 12/2008 | |

OTHER PUBLICATIONS

Invitation to Pay Additional Fees, PCT Application No. PCT/JP2011/058951, dated May 10, 2011, 5 pages.

International Search Report (Application No. PCT/JP2011/058951) dated Jul. 19, 2011, 5 pages.

Written Opinion (Application No. PCT/JP2011/058951) dated Jul. 19, 2011, 6 pages.

Ohara, H et al., "Amorphous In—Ga—Zn-Oxide TFTs with Suppressed Variation for 4.0 inch QVGA AMOLED Display," AM-FPD '09 Digest of Technical Papers, Jul. 1, 2009, pp. 227-230, The Japan Society of Applied Physics.

Orita, M et al., "Amorphous transparent conductive oxide InGaO3(ZnO)m (m<4):a Zn4s conductor," Philosophical Magazine, 2001, vol. 81, No. 5, pp. 501-515.

Orita, M et al., "Mechanism of Electrical Conductivity of Transparent InGaZnO4," Phys. Rev. B (Physical Review. B), Jan. 15, 2000, vol. 61, No. 3, pp. 1811-1816.

Osada, T et al., "15.2: Development of Driver-Integrated Panel using Amorphous In—Ga—Zn-Oxide TFT," SID Digest '09 : SID International Symposium Digest of Technical Papers, May 31, 2009, pp. 184-187.

Osada, T et al., "Development of Driver-Integrated Panel Using Amorphous In—Ga—Zn-Oxide TFT," AM-FPD '09 Digest of Technical Papers, Jul. 1, 2009, pp. 33-36.

Park, J et al., "Dry etching of ZnO films and plasma-induced damage to optical properties," J. Vac. Sci. Technol. B (Journal of Vacuum Science & Technology B), Mar. 1, 2003, vol. 21, No. 2, pp. 800-803.

Park, J et al., "Improvements in the Device Characteristics of Amorphous Indium Gallium Zinc Oxide Thin-Film Transistors by Ar Plasma Treatment," Appl. Phys. Lett. (Applied Physics Letters), Jun. 26, 2007, vol. 90, No. 26, pp. 262106-1-262106-3.

Park, J et al., "Electronic Transport Properties of Amorphous Indium-Gallium-Zinc Oxide Semiconductor Upon Exposure to Water," Appl. Phys. Lett. (Applied Physics Letters), 2008, vol. 92, pp. 072104-1-072104-3.

Park, J et al., "High performance amorphous oxide thin film transistors with self-aligned top-gate structure," IEDM 09: Technical Digest of International Electron Devices Meeting, Dec. 7, 2009, pp. 191-194.

Park, Sang-Hee et al., "42.3: Transparent ZnO Thin Film Transistor for the Application of High Aperture Ratio Bottom Emission AM-OLED Display," SID Digest '08 : SID International Symposium Digest of Technical Papers, May 20, 2008, vol. 39, pp. 629-632.

Park, J et al., "Amorphous Indium-Gallium-Zinc Oxide TFTs and Their Application for Large Size AMOLED," AM-FPD '08 Digest of Technical Papers, Jul. 2, 2008, pp. 275-278.

Park, S et al., "Challenge to Future Displays: Transparent AM-OLED Driven by PEALD Grown ZNO TFT," IMID '07 Digest, 2007, pp. 1249-1252.

Prins, M et al., "A Ferroelectric Transparent Thin-Film Transistor," Appl. Phys. Lett. (Applied Physics Letters), Jun. 17, 1996, vol. 68, No. 25, pp. 3650-3652.

Sakata, J et al., "Development of 4.0-In. AMOLED Display With Driver Circuit Using Amorphous In—Ga—Zn-Oxide TFTs," IDW '09 : Proceedings of the 16th International Display Workshops, 2009, pp. 689-692.

Son, K et al., "42.4L: Late-News Paper: 4 Inch QVGA AMOLED Driven by the Threshold Voltage Controlled Amorphous GIZO(Ga2O3-In2O3-ZnO) TFT," SID Digest '08 : SID International Symposium Digest of Technical Papers, May 20, 2008, vol. 39, pp. 633-636.

Takahashi, M et al., "Theoretical Analysis of IGZO Transparent Amorphous Oxide Semiconductor," IDW '08 : Proceedings of the 15th International Display Workshops, Dec. 3, 2008, pp. 1637-1640.

Ueno, K et al., "Field-Effect Transistor on SrTiO3 with Sputtered Al2O3 Gate Insulator," Appl. Phys. Lett. (Applied Physics Letters), Sep. 1, 2003, vol. 83, No. 9, pp. 1755-1757.

Van De Walle, C, "Hydrogen as a Cause of Doping in Zinc Oxide," Phys. Rev. Lett. (Physical Review Letters), Jul. 31, 2000, vol. 85, No. 5, pp. 1012-1015.

Asakuma, N et al., "Crystallization and Reduction of Sol-Gel-Derived Zinc Oxide Films by Irradiation With Ultraviolet Lamp," Journal of Sol-Gel Science and Technology, 2003, vol. 26, pp. 181-184.

Asaoka, Y et al., "29.1: Polarizer-Free Reflective LCD Combined With Ultra Low-Power Driving Technology," SID Digest '09 : SID International Symposium Digest of Technical Papers, 2009, pp. 395-398.

Chern, H et al., "An Analytical Model for the Above-Threshold Characteristics of Polysilicon Thin-Film Transistors," IEEE Transactions on Electron Devices, Jul. 1, 1995, vol. 42, No. 7, pp. 1240-1246.

Cho, D et al., "21.2: Al and Sn-Doped Zinc Indium Oxide Thin Film Transistors for AMOLED Back-Plane," SID Digest '09 : SID International Symposium Digest of Technical Papers, May 31, 2009, pp. 280-283.

Clark, S et al., "First Principles Methods using CASTEP," Zeitschrift fur Kristallographie, 2005, vol. 220, pp. 567-570.

Coates. D et al., "Optical Studies of the Amorphous Liquid-Cholesteric Liquid Crystal Transition: The Blue Phase," Physics Letters, Sep. 10, 1973, vol. 45A, No. 2, pp. 115-116.

Costello, M et al., "Electron Microscopy of a Cholesteric Liquid Crystal and Its Blue Phase," Phys. Rev. A (Physical Review. A), May 1, 1984, vol. 29, No. 5, pp. 2957-2959.

Dembo, H et al., "RFCPUS on Glass and Plastic Substrates Fabricated by TFT Transfer Technology," IEDM 05: Technical Digest of International Electron Devices Meeting, Dec. 5, 2005, pp. 1067-1069.

Fortunato, E et al., "Wide-Bandgap High-Mobility ZNO Thin-Film Transistors Produced at Room Temperature," Appl. Phys. Lett. (Applied Physics Letters), Sep. 27, 2004, vol. 85, No. 13, pp. 2541-2543.

Fung, T et al., "2-D Numerical Simulation of High Performance Amorphous In—Ga—Zn—O TFTs for Flat Panel Displays," AM-FPD '08 Digest of Technical Papers, Jul. 2, 2008, pp. 251-252, The Japan Society of Applied Physics.

(56) References Cited

OTHER PUBLICATIONS

Godo, H et al., "P-9: Numerical Analysis on Temperature Dependence of Characteristics of Amorphous In—Ga—Zn-Oxide TFT," SID Digest '09 : SID International Symposium Digest of Technical Papers, May 31, 2009, pp. 1110-1112.
Godo, H et al., "Temperature Dependence of Characteristics and Electronic Structure for Amorphous In—Ga—Zn-Oxide TFT," AM-FPD '09 Digest of Technical Papers, Jul. 1, 2009, pp. 41-44.
Hayashi, R et al., "42.1: Invited Paper: Improved Amorphous In—Ga—Zn—O TFTs," SID Digest '08 : SID International Symposium Digest of Technical Papers, May 20, 2008, vol. 39, pp. 621-624.
Hirao, T et al., "Novel Top-Gate Zinc Oxide Thin-Film Transistors (ZNO TFTs) for AMLCDs," Journal of the SID , 2007, vol. 15, No. 1, pp. 17-22.
Hosono, H et al., "Working hypothesis to explore novel wide band gap electrically conducting amorphous oxides and examples," J. Non-Cryst. Solids (Journal of Non-Crystalline Solids), 1996, vol. 198-200, pp. 165-169.
Hosono, H, "68.3: Invited Paper:Transparent Amorphous Oxide Semiconductors for High Performance TFT," SID Digest '07 : SID International Symposium Digest of Technical Papers, 2007, vol. 38, pp. 1830-1833.
Hsieh, H et al., "P-29: Modeling of Amorphous Oxide Semiconductor Thin Film Transistors and Subgap Density of States," SID Digest '08 : SID International Symposium Digest of Technical Papers, 2008, vol. 39, pp. 1277-1280.
Ikeda, T et al., "Full-Functional System Liquid Crystal Display Using Cg-Silicon Technology," SID Digest '04 : SID International Symposium Digest of Technical Papers, 2004, vol. 35, pp. 860-863.
Janotti, A et al., "Native Point Defects in ZnO," Phys. Rev. B (Physical Review. B), 2007, vol. 76, No. 16, pp. 165202-1-165202-22.
Janotti, A et al., "Oxygen Vacancies In ZnO," Appl. Phys. Lett. (Applied Physics Letters), 2005, vol. 87, pp. 122102-1-122102-3.
Jeong, J et al., "3.1: Distinguished Paper: 12.1-Inch WXGA AMOLED Display Driven by Indium-Gallium-Zinc Oxide TFTs Array," SID Digest '08 : SID International Symposium Digest of Technical Papers, May 20, 2008, vol. 39, No. 1, pp. 1-4.
Jin, D et al., "65.2: Distinguished Paper:World-Largest (6.5") Flexible Full Color Top Emission AMOLED Display on Plastic Film and Its Bending Properties," SID Digest '09 : SID International Symposium Digest of Technical Papers, May 31, 2009, pp. 983-985.
Kanno, H et al., "White Stacked Electrophosphorecent Organic Light-Emitting Devices Employing MOO3 as a Charge-Generation Layer," Adv. Mater. (Advanced Materials), 2006, vol. 18, No. 3, pp. 339-342.
Kikuchi, H et al., "39.1: Invited Paper: Optically Isotropic Nano-Structured Liquid Crystal Composites for Display Applications," SID Digest '09 : SID International Symposium Digest of Technical Papers, May 31, 2009, pp. 578-581.
Kikuchi, H et al., "62.2: Invited Paper: Fast Electro-Optical Switching in Polymer-Stabilized Liquid Crystalline Blue Phases for Display Application," SID Digest '07 : SID International Symposium Digest of Technical Papers, 2007, vol. 38, pp. 1737-1740.
Kikuchi, H et al., "Polymer-Stabilized Liquid Crystal Blue Phases," Nature Materials, Sep. 1, 2002, vol. 1, pp. 64-68.
Kim, S et al., "High-Performance oxide thin film transistors passivated by various gas plasmas," The Electrochemical Society, 214th ECS Meeting, 2008, No. 2317, 1 page.
Kimizuka, N et al., "SPINEL,YbFe2O4, and Yb2Fe3O7 Types of Structures for Compounds in the In2O3 and SC2O3-A2O3-BO Systems [A; Fe, Ga, or Al; B: Mg, Mn, Fe, Ni, Cu,or Zn] at Temperatures Over 1000° C," Journal of Solid State Chemistry, 1985, vol. 60, pp. 382-384.
Kimizuka, N et al., "Syntheses and Single-Crystal Data of Homologous Compounds, In2O3(ZnO)m (m = 3, 4, and 5), InGaO3(ZnO)3, and Ga2O3(ZnO)m (m = 7, 8, 9, and 16) in the In2O3-ZnGa2O4-ZnO System," Journal of Solid State Chemistry, Apr. 1, 1995, vol. 116, No. 1, pp. 170-178.
Kitzerow, H et al., "Observation of Blue Phases in Chiral Networks," Liquid Crystals, 1993, vol. 14, No. 3, pp. 911-916.
Kurokawa, Y et al., "UHF RFCPUS on Flexible and Glass Substrates for Secure RFID Systems," Journal of Solid-State Circuits , 2008, vol. 43, No. 1, pp. 292-299.
Lany, S et al., "Dopability, Intrinsic Conductivity, and Nonstoichiometry of Transparent Conducting Oxides," Phys. Rev. Lett. (Physical Review Letters), Jan. 26, 2007, vol. 98, pp. 045501-1-045501-4.
Lee, H et al., "Current Status of, Challenges to, and Perspective View of AM-OLED," IDW '06 : Proceedings of the 13th International Display Workshops, Dec. 7, 2006, pp. 663-666.
Lee, J et al., "World's Largest (15-Inch) XGA AMLCD Panel Using IGZO Oxide TFT," SID Digest '08 : SID International Symposium Digest of Technical Papers, May 20, 2008, vol. 39, pp. 625-628.
Lee, M et al., "15.4: Excellent Performance of Indium-Oxide-Based Thin-Film Transistors by DC Sputtering," SID Digest '09 : SID International Symposium Digest of Technical Papers, May 31, 2009, pp. 191-193.
Li, C et al., "Modulated Structures of Homologous Compounds InMO3(ZnO)m (M=In,Ga; m=Integer) Described by Four-Dimensional Superspace Group," Journal of Solid State Chemistry, 1998, vol. 139, pp. 347-355.
Masuda, S et al., "Transparent thin film transistors using ZnO as an active channel layer and their electrical properties," J. Appl. Phys. (Journal of Applied Physics), Feb. 1, 2003, vol. 93, No. 3, pp. 1624-1630.
Meiboom, S et al., "Theory of the Blue Phase of Cholesteric Liquid Crystals," Phys. Rev. Lett. (Physical Review Letters), May 4, 1981, vol. 46, No. 18, pp. 1216-1219.
Miyasaka, M, "SUFTLA Flexible Microelectronics on Their Way to Business," SID Digest '07 : SID International Symposium Digest of Technical Papers, 2007, vol. 38, pp. 1673-1676.
Mo, Y et al., "Amorphous Oxide TFT Backplanes for Large Size AMOLED Displays," IDW '08 : Proceedings of the 6th International Display Workshops, Dec. 3, 2008, pp. 581-584.
Nakamura, "Synthesis of Homologous Compound with New Long-Period Structure," NIRIM Newsletter, Mar. 1995, vol. 150, pp. 1-4 with English translation.
Nakamura, M et al., "The phase relations in the In2O3-Ga2ZnO4-ZnO system at 1350° C," Journal of Solid State Chemistry, Aug. 1, 1991, vol. 93, No. 2, pp. 298-315.
Nomura, K et al., "Thin-Film Transistor Fabricated in Single-Crystalline Transparent Oxide Semiconductor," Science, May 23, 2003, vol. 300, No. 5623, pp. 1269-1272.
Nomura, K et al., "Amorphous Oxide Semiconductors for High-Performance Flexible Thin-Film Transistors," Jpn. J. Appl. Phys. (Japanese Journal of Applied Physics) , 2006, vol. 45, No. 5B, pp. 4303-4308.
Nomura, K et al., "Room-Temperature Fabrication of Transparent Flexible Thin-Film Transistors Using Amorphous Oxide Semiconductors," Nature, Nov. 25, 2004, vol. 432, pp. 488-492.
Nomura, K et al., "Carrier transport in transparent oxide semiconductor with intrinsic structural randomness probed using single-crystalline InGaO3(ZnO)5 films," Appl. Phys. Lett. (Applied Physics Letters) , Sep. 13, 2004, vol. 85, No. 11, pp. 1993-1995.
Nowatari, H et al., "60.2: Intermediate Connector With Suppressed Voltage Loss for White Tandem OLEDs," SID Digest '09 : SID International Symposium Digest of Technical Papers, May 31, 2009, vol. 40, pp. 899-902.
Oba, F et al., "Defect energetics in ZnO: A hybrid Hartree-Fock density functional study," Phys. Rev. B (Physical Review. B), 2008, vol. 77, pp. 245202-1-245202-6.
Oh, M et al., "Improving the Gate Stability of ZNO Thin-Film Transistors With Aluminum Oxide Dielectric Layers," J. Electrochem. Soc. (Journal of the Electrochemical Society), 2008, vol. 155, No. 12, pp. H1009-H1014.
Ohara, H et al., "21.3: 4.0 In. QVGA AMOLED Display Using In—Ga—Zn-Oxide TFTs With a Novel Passivation Layer," SID Digest '09 : SID International Symposium Digest of Technical Papers, May 31, 2009, pp. 284-287.
Taiwanese Office Action (Application No. 105128789) Dated Oct. 26, 2016.

(56) References Cited

OTHER PUBLICATIONS

Taiwanese Office Action (Application No. 100113721) dated Mar. 24, 2016.

* cited by examiner

LIQUID CRYSTAL DISPLAY DEVICE AND DRIVING METHOD THEREOF

TECHNICAL FIELD

The present invention relates to a display device and a driving method of the display device.

BACKGROUND ART

Higher integration of a semiconductor element and enhanced processing ability of an arithmetic element have led to reduction in size and weight of electronic devices and availability of portable highly functional electronic devices. Further, sufficient information distribution infrastructure in a society, as well as increased capacity of a memory element, has enabled users to deal with a large amount of information with portable electronic devices even when the users are outside the house. In particular, the degree of importance of display devices that visually transmit information to users has been increasing with the development of electronic devices.

However, it is desirable that portable electronic devices continuously operate for a long time even when it is difficult to receive power from a lamp line. An increase in capacity of a battery and a reduction in power consumption are strongly demanded in order to increase the operation time of the portable electronic devices.

Further, a reduction in power consumption of electronic devices is an urgent task also from the viewpoint of current energy issues. A technique for suppressing power consumption of television devices which have been increasing in size, as well as portable electronic devices, has been demanded.

In a conventional display device, writing operations of the same image data are performed at regular intervals even in the case where image data in successive periods are the same. In order to suppress power consumption of such a display device, for example, a technique has been reported in which a break period which is longer than a scanning period is set as a non-scanning period every time after image data is written by scanning a screen in the case of displaying a still image (e.g., see Patent Document 1 and Non-Patent Document 1).

[Patent Document 1] U.S. Pat. No. 7,321,353

[Non-Patent Document 1] K. Tsuda et al., IDW' 02, Proc., pp. 295-298

DISCLOSURE OF INVENTION

Power consumption of a display device is the sum of power consumed by a display panel in a writing operation and power consumed by the display panel in a period in which a written image is held (the period is also referred to as an image holding period). Therefore, suppression of power consumed in the image holding period is needed as well as a reduction in frequency of image writing to the display panel of the display device.

The present invention was made in view of the foregoing technical background. It is an object of one embodiment of the present invention to provide a display device in which power consumed in an image holding period is suppressed.

In order to achieve the above object, one embodiment of the present invention focuses on power consumed by a DC-DC converter of a power supply circuit provided in a driver circuit for a display panel in an image holding period.

For example, a power supply circuit needs to supply a fixed potential to a common electrode so that the quality of image data held by a capacitor formed between a pixel electrode of each pixel and a common electrode which are provided in a liquid crystal display panel is kept high without deterioration in an image holding period. The fixed potential to be supplied to the common electrode is generated by the DC-DC converter provided in the power supply circuit, with the use of power supplied from an external power supply such as a battery. Thus, the conversion efficiency of the DC-DC converter affects power consumed in the image holding period.

The conversion efficiency of the DC-DC converter is expressed as a ratio of output power to consumed power. It is preferable to use a DC-DC converter which has high conversion efficiency when a load connected is large. However, the conversion efficiency of the DC-DC converter changes depending on the size of the load connected; therefore, the DC-DC converter which has high conversion efficiency when the load is large cannot be expected to have high conversion efficiency also when the load is small.

For example, in the case where a liquid crystal display panel is connected as a load, a DC-DC converter which has conversion efficiency as high as 75% in a writing operation is used. However, power consumed in an image holding period is approximately $10^{-1}$ to $10^{-4}$ times as much as power consumed in the writing operation, and the conversion efficiency of the DC-DC converter in the image holding period is reduced to approximately several tens of percent in some cases.

Thus, the present inventors came up with an idea that a DC-DC converter which has high conversion efficiency is used when a load is large and a fixed potential is supplied with another means when the load is small, in order to reduce power consumed by the DC-DC converter to which the load with large variation is connected.

Specifically, a converter which converts a power supply input into predetermined direct-current power and a backup circuit may be provided in a liquid crystal display device; a fixed potential is supplied and a capacitor provided in the backup circuit is charged with the use of the converter in a writing operation where the load is large; and the fixed potential is preferentially supplied from the charged capacitor without using the converter in an image holding period that the load is small.

Note that the backup circuit has a first mode in which power is supplied from a power supply to the liquid crystal display panel and the capacitor through the converter and a second mode in which power supply from the power supply to the converter is stopped and the power stored in the capacitor is supplied to the liquid crystal display panel.

In other words, one embodiment of the present invention includes: a converter for converting a power supply input into predetermined direct-current power; a backup circuit which includes a capacitor charged with power output from the converter; and a liquid crystal display panel which is driven by power supplied from the converter or the backup circuit, has a function of holding one image for a certain period, and has power consumption of image writing 10 times to $10^4$ times as much as that of an image holding period. Moreover, the backup circuit has a first mode in which power is supplied to the liquid crystal display panel and the capacitor through the converter and a second mode in which power supply to the converter is stopped and the power stored in the capacitor is supplied to the liquid crystal display panel. In addition, one embodiment of the present invention is a liquid crystal display device which supplies power to the liquid crystal display panel in the second mode in the image holding period.

According to the embodiment of the present invention, in a period in which the liquid crystal display panel holds one image, the converter for converting a power supply input into predetermined direct-current power is stopped and the capacitor in the backup circuit supplies a fixed potential to the liquid crystal display panel. Accordingly, the converter does not consume power in the image holding period of the liquid crystal display panel, which is a load region with low conversion efficiency of the converter, specifically, a region with an extremely small load. Thus, a liquid crystal display device in which power consumed in the image holding period is suppressed can be provided.

Further, one embodiment of the present invention includes: a converter for converting a power supply input into predetermined direct-current power; a backup circuit which includes a capacitor charged with power output from the converter; and a liquid crystal display panel which is driven by power supplied from the converter or the backup circuit, has a function of holding the image for a certain period, and has power consumption of image writing 10 times to $10^4$ times as much as that of an image holding period. Moreover, the backup circuit has a first mode in which power is supplied to the liquid crystal display panel and the capacitor to which a limiter circuit is connected, through the converter and a second mode in which power supply to the converter is stopped and the power stored in the capacitor is supplied to the liquid crystal display panel. In addition, one embodiment of the present invention is a liquid crystal display device which supplies power to the liquid crystal display panel in the second mode in the image holding period.

According to the embodiment of the present invention, in a period in which the liquid crystal display panel holds one image, the converter is stopped and the capacitor in the backup circuit with a charging limiter supplies a fixed potential to the liquid crystal display panel. Accordingly, the converter does not consume power in the image holding period of the liquid crystal display panel, which is a load region with low conversion efficiency of the converter, specifically, a region with an extremely small load. Thus, a liquid crystal display device in which power consumed in the image holding period is suppressed can be provided.

Further, one embodiment of the present invention is provided with the backup circuit with the charging limiter. The capacitor in the backup circuit with the charging limiter is connected to the converter through the limiter circuit; thus, even when the capacitor before being filled with electric charge is connected to the converter, a defect of the capacitor due to rapid charging can be prevented.

Further, according to one embodiment of the present invention, the same image signals are written to the liquid crystal display panel at intervals longer than or equal to 10 seconds and shorter than or equal to 600 seconds in the above liquid crystal display device.

According to the embodiment of the present invention, the length of period in which the converter is stopped can be lengthened, which has a pronounced effect on a reduction in power consumption.

Further, one embodiment of the present invention is a driving method of a liquid crystal display device including the steps of: charging a capacitor provided in a backup circuit and writing an image to a liquid crystal display panel, with the use of power supplied through a converter for converting a power supply input into predetermined direct-current power; monitoring a gate potential of a pixel transistor of the liquid crystal display panel and the potential of the capacitor provided in the backup circuit at set intervals; supplying power to the converter when the absolute value of the gate potential of the pixel transistor is smaller than a first set potential; cutting the power supplied to the converter when the potential of the capacitor is higher than a second set potential; and repeating the above monitoring operation until set time or an interrupt instruction.

According to the embodiment of the present invention, a fixed potential to be supplied to the liquid crystal display panel in an image holding period is selected in accordance with the potential of the capacitor provided in the backup circuit. Accordingly, the converter does not consume power in the image holding period of the liquid crystal display panel, which is a load region with low conversion efficiency of the converter, specifically, a region with an extremely small load. Thus, a driving method of a liquid crystal display device in which power consumed in the image holding period is suppressed can be provided.

According to the embodiment of the present invention, power is supplied to the converter when the absolute value of the gate potential of the pixel transistor is smaller than the set potential, and the power supply to the converter is cut off when the potential of the capacitor on the liquid crystal display panel side is higher than the set potential. Accordingly, the backup circuit serves as a load of the converter, and the capacitor in the backup circuit can be charged with the use of a region with high conversion efficiency.

Further, according to one embodiment of the present invention, the first set potential is greater than or equal to 5 V in the above driving method of the liquid crystal display device.

According to the embodiment of the present invention, the absolute value of the gate potential of the pixel transistor provided in a pixel portion of the liquid crystal display panel is kept larger than 5 V. Accordingly, the pixel transistor can remain off by the potential supplied by the backup circuit, and distortion of a stored image can be prevented.

Further, according to one embodiment of the present invention, the second set potential is less than or equal to 98% of the output potential of the converter in the above driving method of the liquid crystal display device.

According to the embodiment of the present invention, when charging of the capacitor provided in the backup circuit is too close to the termination, the load becomes small. Charging in this region with a small load is eliminated, whereby the capacitor in the backup circuit can be charged by preferentially using a region with high conversion efficiency.

Note that in this specification, a high power supply potential Vdd refers to a potential that is higher than a reference potential, and a low power supply potential Vss refers to a potential that is lower than or equal to a reference potential. Further, it is preferable that each of the high power supply potential Vdd and the low power supply potential Vss be a potential at which a transistor can operate. Note that the high power supply potential Vdd and the low power supply potential Vss are collectively referred to as a power supply voltage in some cases. Further, being "connected" means being "electrically connected" in this specification.

Further, in this specification, a common potential Vcom may be any potential as long as it is a fixed potential serving as a reference with respect to a potential of an image signal supplied to a pixel electrode. The common potential may be, for example, a ground potential.

According to the present invention, a display device in which power consumed in an image holding period is reduced can be provided.

BEST MODE FOR CARRYING OUT THE INVENTION

Figure 1:
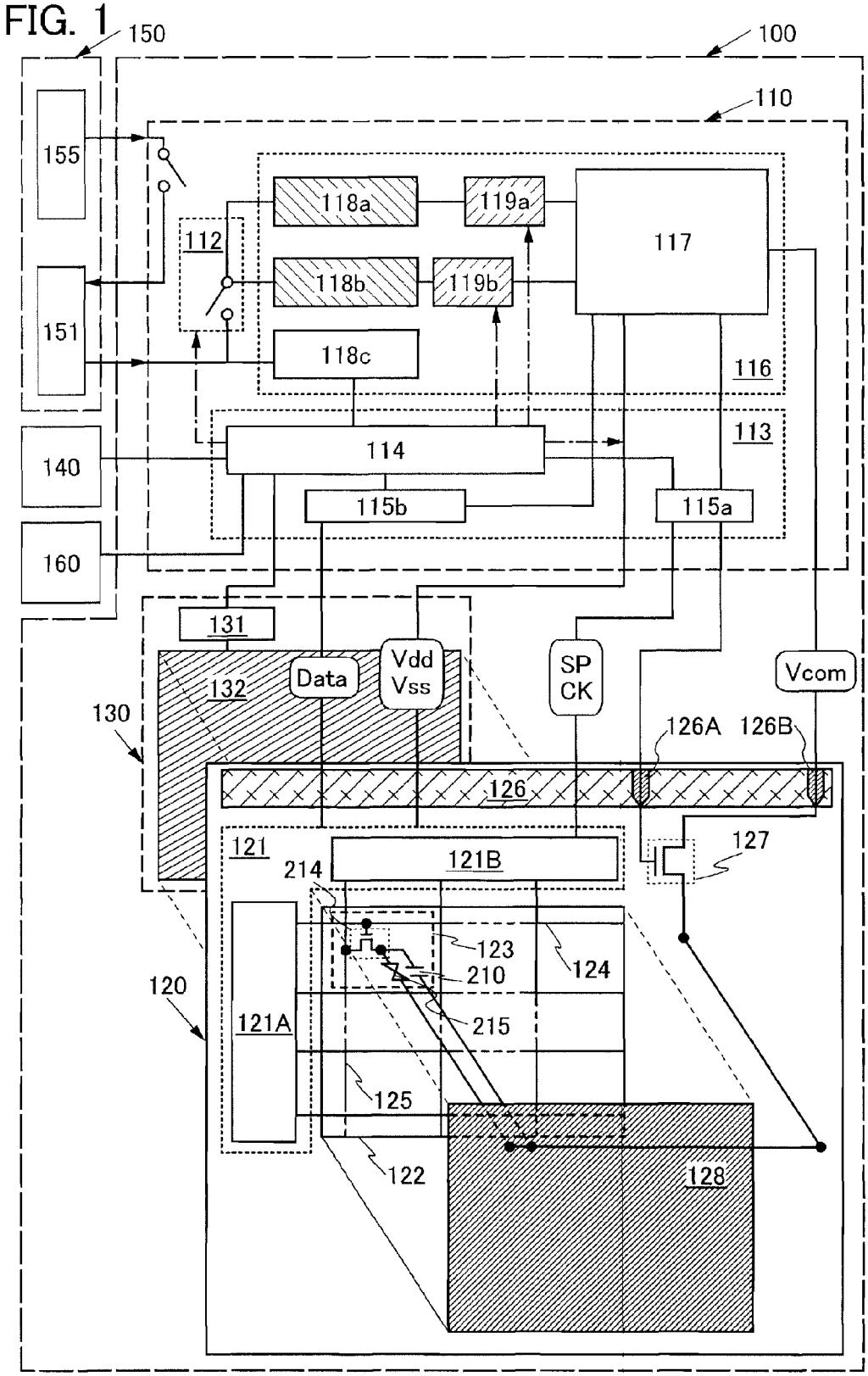
FIG. 1 is a block diagram illustrating a structure of a liquid crystal display device according to Embodiment.

Embodiments, Example, and Comparative Example will be described in detail with reference to the accompanying drawings. Note that the present invention is not limited to the description below, and it is easily understood by those skilled in the art that a variety of changes and modifications can be made without departing from the spirit and scope of the present invention. Therefore, the present invention should not be construed as being limited to the description of embodiments and examples below. Note that in the structures of the present invention described below, the same portions or portions having similar functions are denoted by the same reference numerals in different drawings, and description of such portions is not repeated.

Embodiment 1

In this embodiment, a liquid crystal display device which includes a liquid crystal display panel driven by power supplied from a converter for converting an input power supply potential into a direct-current potential or a backup circuit will be described with reference to FIG. 1 and FIG. 2.

A structure of a liquid crystal display device 100, which is described as an example in this embodiment, will be described with reference to the block diagram of FIG. 1. The liquid crystal display device 100 includes a driver circuit portion 110, a liquid crystal display panel 120, a memory device 140, a power supply portion 150, and an input device 160. Note that a backlight portion 130 can be provided when needed.

In the liquid crystal display device 100, a power supply circuit 116 is supplied with power from the power supply portion 150. The power supply circuit 116 supplies power supply potentials to a display control circuit 113 and the liquid crystal display panel 120. The display control circuit 113 takes in electronic data stored in the memory device 140 and outputs the electronic data to the liquid crystal display panel 120. In the case where the backlight portion 130 is provided, the display control circuit 113 outputs power supply potentials and control signals to the backlight portion 130.

The driver circuit portion 110 includes a switching circuit 112, the display control circuit 113, and the power supply circuit 116. The display control circuit 113 includes an arithmetic circuit 114, a signal generation circuit 115*a*, and a liquid crystal driver circuit 115*b*. The power supply circuit 116 includes a power supply potential generation circuit 117, a first DC-DC converter 118*a*, a second DC-DC converter 118*b*, a third DC-DC converter 118*c*, a first backup circuit 119*a*, and a second backup circuit 119*b*.

In the power supply circuit 116, the first DC-DC converter 118*a* boosts a power supply potential supplied from the power supply portion 150, with the first backup circuit 119*a*, and then the potential is supplied to the power supply potential generation circuit 117; and the second DC-DC converter 118*b* inverts a power supply potential supplied from the power supply portion 150, with the second backup circuit 119*b*, and then the potential is supplied to the power supply potential generation circuit 117. The power supply potential generation circuit 117 supplies power supply potentials (a high power supply potential Vdd and a low power supply potential Vss) to the display control circuit 113 and supplies a common potential Vcom to the liquid crystal display panel 120. In addition, the third DC-DC converter 118*c* steps down power supplied from the power supply portion 150 and supplies the power to the arithmetic circuit 114 in the display control circuit 113.

Configurations of the first backup circuit 119*a* and the second backup circuit 119*b* will be described with reference to the block diagram of FIG. 2. Note that FIG. 2 is a block diagram mainly illustrating a configuration of the power supply circuit 116 in FIG. 1 and that components in FIG. 2 which are common to those in FIG. 1 are denoted by the same reference numerals as in FIG. 1. The first backup circuit 119*a* and the second backup circuit 119*b* have the same configuration; therefore, only the first backup circuit 119*a* will be described here.

In the first backup circuit 119*a*, one of terminals of a first switch 190*a* is connected to a terminal of the first DC-DC converter 118*a*. In addition, one of terminals of a first limiter circuit 191*a* is connected to the terminal of the first DC-DC converter 118*a*, and the other terminal of the first limiter circuit 191*a* is connected to one of terminals of a second switch 193*a*. The other terminal of the second switch 193*a* is connected to one of terminals, i.e., a terminal 195*a* of a capacitor 192*a* and one of terminals of a third switch 194*a*, and the other terminal of the capacitor 192*a* is grounded. The other terminal of the first switch 190*a* and the other terminal of the third switch 194*a* are both connected to the power supply potential generation circuit 117, so that a potential supplied from the first DC-DC converter 118*a* is output to the liquid crystal display panel 120 which is not illustrated in FIG. 2 through the power supply potential generation circuit 117.

The first backup circuit 119*a*, which is described as an example in this embodiment, is provided with the first limiter circuit 191*a* as well as the capacitor, and thus can also be referred to as a backup circuit with a charging limiter. The first limiter circuit 191*a* controls current flowing through the first DC-DC converter 118*a* when the capacitor 192*a* is in a low charging state, suppresses a decrease in potential output from the first DC-DC converter 118*a*, and stabilizes the operation of the liquid crystal display device 100. Note that a structure in which the limiter circuit is not used can be employed.

The arithmetic circuit 114 monitors the power supply circuit 116. Specifically, the arithmetic circuit 114 monitors a potential of the terminal 195*a* of the capacitor 192*a* in the first backup circuit 119*a*, a potential of a terminal 195*b* of the capacitor 192*b* in the second backup circuit 119*b*, and the power supply potentials (e.g., Vdd and Vss) output from the power supply potential generation circuit 117. Monitoring these potentials makes it possible to know the charging states of the capacitor 192*a* and the capacitor 192*b* and the display state of the liquid crystal display panel 120.

Moreover, the arithmetic circuit 114 controls the switching circuit 112. The arithmetic circuit 114 can control power supply to the first DC-DC converter 118*a* and the second DC-DC converter 118*b* with the use of the switching circuit 112 in accordance with the charging states of the capacitor 192*a* and the capacitor 192*b* (or the potentials of the terminal 195*a* and the terminal 195*b*) or the gate potential of a pixel transistor (or the potential of a wiring electrically connected to a gate electrode of the pixel transistor).

Note that the timing of connection and disconnection of the first switch 190*a*, a first switch 190*b*, the second switch 193*a*, a second switch 193*b*, the third switch 194*a*, and a third switch 194*b* is synchronized with the timing of connection and disconnection of the switching circuit 112. Specifically, in a state in which the power supply portion 150 and the power supply circuit 116 are connected to each other through the switching circuit 112, all of the first switch 190*a*, the first switch 190*b*, the second switch 193*a*, and the second switch 193*b* are in a connection state, while the third switch 194*a* and the third switch 194*b* are in a disconnection state. Further, when the switching circuit 112 is in a disconnection state, all of the first switch 190*a*, the first switch 190*b*, the second switch 193*a*, and the second switch 193*b* are in a disconnection state, while the third switch 194*a* and the third switch 194*b* are in a connection state. Note that the backup circuit can include a rectifying element instead of the switch.

Power supply to the first DC-DC converter 118*a* and the second DC-DC converter 118*b* is controlled, whereby fixed potentials can be supplied and the capacitors can be charged with the use of the DC-DC converters in a writing operation where a load is large, while the fixed potentials can be preferentially supplied from the capacitors without using the DC-DC converters in an image holding period when the load is small.

In the display control circuit 113 (see FIG. 1), the arithmetic circuit 114 analyzes, calculates, and processes electronic data taken out of the memory device 140. A processed image as well as a control signal is output to the liquid crystal driver circuit 115*b*, and the liquid crystal driver circuit 115*b* converts the image into an image signal Data that the liquid crystal display panel 120 can display and outputs the image signal Data. Further, the signal generation circuit 115*a* is synchronized with the arithmetic circuit 114 and supplies control signals (a start pulse SP and a clock signal CK), which are generated with the use of a power supply potential, to the liquid crystal display panel 120. Note that the arithmetic circuit 114 may output a control signal, which is for bringing the potential of a common electrode 128 in the liquid crystal display panel 120 into a floating state, to a switching element 127 through the signal generation circuit 115*a*.

The image signal Data may be inverted by a method such as dot inversion driving, source line inversion driving, gate line inversion driving, or frame inversion driving as appropriate. Further, an image signal may be input from the outside, and in the case where the image signal is an analog signal, it may be converted into a digital signal through an A/D converter or the like to be supplied to the liquid crystal display device 100.

Moreover, the arithmetic circuit 114 controls power supply from the power supply portion 150 to the first DC-DC converter 118*a* and the second DC-DC converter 118*b* with the use of the switching circuit 112. Furthermore, the arithmetic circuit 114 monitors the charging states of the capacitors in the first backup circuit 119*a* and the second backup circuit 119*b* and the gate potential of the display panel.

As for the analysis, calculation, and processing of the electronic data taken out of the memory device, which are performed by the arithmetic circuit 114, for example, the arithmetic circuit 114 can analyze the electronic data to determine whether the data is for a moving image or a still image and can output a control signal including the determination result to the signal generation circuit 115*a* and the liquid crystal driver circuit 115*b*. Moreover, the arithmetic circuit 114 can extract data of a still image for one frame from image signal Data including the data for a still image, and can output the extracted data, as well as a control signal which indicates that the extracted data is for a still image, to the signal generation circuit 115*a* and the liquid crystal driver circuit 115*b*. Furthermore, the arithmetic circuit 114 can detect data for a moving image from the image signal Data including the data for a moving image, and can output data for successive frames, as well as a control signal which indicates that the detected data is for a moving image, to the liquid crystal display panel 120.

The arithmetic circuit 114 makes the liquid crystal display device 100 of this embodiment operate in different manners depending on input electronic data. Note that in this embodiment, a mode of operation performed when the arithmetic circuit 114 determines an image as a still image is referred to a still image display mode, whereas a mode of operation performed when the arithmetic circuit 114 determines an image as a moving image is referred to a moving image display mode. Further, in this specification, an image displayed in the still image display mode is referred to as a still image.

Further, the arithmetic circuit 114 which is described as an example in this embodiment may have a function of switching the display mode. The function of switching the display mode is a function of switching the display mode between the moving image display mode and the still image display mode without a determination by the arithmetic circuit 114 in such a manner that a user selects an operation mode of the liquid crystal display device by hand or by using an external connection device.

The above function is an example of functions of the arithmetic circuit 114, and a variety of image processing functions can be applied depending on the applications of the display device.

Note that an arithmetic operation (e.g., detection of a difference between image signals) is easily performed on an image signal that has been converted into a digital signal; thus, in the case where an input image signal (image signal Data) is an analog signal, an A/D converter or the like can be provided in the arithmetic circuit 114.

The memory device 140 has a memory medium and a reading device. Note that a structure in which data can be written to the memory medium may be employed.

The power supply portion 150 includes a secondary battery 151 and a solar cell 155. A capacitor can be used as the secondary battery. Note that the power supply portion 150 is not limited thereto, and an AC-DC converter connected to a lamp line, besides a battery, a power generation device, or the like, may be applied to the power supply portion 150.

As the input device 160, a switch or a keyboard may be used, and the liquid crystal display panel 120 may be provided with a touch panel. A user can select electronic data stored in the memory device 140 by using the input device 160 and can input an instruction to display an image to the liquid crystal display device 100.

The liquid crystal display panel 120 includes a pair of substrates (a first substrate and a second substrate). A liquid crystal layer is sandwiched between the pair of substrates, and a liquid crystal element 215 is formed. A pixel driver circuit portion 121, a pixel portion 122, and a terminal portion 126 are provided over the first substrate. In addition, the switching element 127 may be provided. The common electrode (also referred to as a counter electrode) 128 is provided on the second substrate. Note that in this embodiment, a common connection portion (also referred to as a common contact) is provided for the first substrate or the second substrate, so that a connection portion over the first substrate is connected to the common electrode 128 on the second substrate.

In the pixel portion 122, a plurality of gate lines (scan lines) 124 and a plurality of source lines (signal lines) 125 are provided. A plurality of pixels 123 are arranged in matrix so that each of the plurality of pixels 123 is surrounded by the gate lines 124 and the source lines 125. Note that in the liquid crystal display panel 120 described as an example in this embodiment, the gate lines 124 are extended from a gate line driver circuit 121A, and the source lines 125 are extended from a source line driver circuit 121B.

The pixels 123 each include a transistor 214 as a switching element, and a capacitor 210 and the liquid crystal element 215 which are connected to the transistor 214.

In the transistor 214, a gate electrode is connected to one of the plurality of gate lines 124 provided in the pixel portion 122, one of a source electrode and a drain electrode is connected to one of the plurality of source lines 125, and the other of the source electrode and the drain electrode is connected to one of the electrodes of the capacitor 210 and one of electrodes (a pixel electrode) of the liquid crystal element 215.

As the transistor 214, a transistor with less off-state current is preferably used; a transistor described in Embodiment 3 is preferable. When the off-state current of the transistor 214 is small, electric charge can be stably held in the liquid crystal element 215 and the capacitor 210. Further, the use of the transistor 214 which has sufficiently reduced off-state current makes it possible to form the pixel 123 without providing the capacitor 210.

Such a structure enables the pixel 123 to maintain the state of data for a long time, which has been written before the transistor 214 is turned off, so that power consumption can be reduced.

The liquid crystal element 215 is an element that controls transmission and non-transmission of light by the optical modulation action of liquid crystals. The optical modulation action of liquid crystals is controlled by an electric field applied to the liquid crystals. The direction of the electric field applied to the liquid crystals varies depending on a liquid crystal material, a driving method, and an electrode structure and is selected as appropriate. For example, in the case where a driving method in which an electric field is applied in a direction of a thickness of a liquid crystal (a so-called perpendicular direction) is used, a pixel electrode and a common electrode are provided on the first substrate and the second substrate, respectively, so that the liquid crystal is interposed between the pixel electrode and the common electrode. In the case where a driving method in which an electric field is applied in an in-plane direction of the substrate (a so-called horizontal direction) is used, the pixel electrode and the common electrode may be provided on the same substrate with respect to the liquid crystal. The pixel electrode and the common electrode may have a variety of opening patterns.

As examples of a liquid crystal applied to the liquid crystal element, the following can be given: a nematic liquid crystal, a cholesteric liquid crystal, a smectic liquid crystal, a discotic liquid crystal, a thermotropic liquid crystal, a lyotropic liquid crystal, a low-molecular liquid crystal, a polymer dispersed liquid crystal (PDLC), a ferroelectric liquid crystal, an anti-ferroelectric liquid crystal, a main-chain liquid crystal, a side-chain polymer liquid crystal, a banana-shaped liquid crystal, and the like.

In addition, any of the following can be used as a driving mode of a liquid crystal: a TN (twisted nematic) mode, an STN (super twisted nematic) mode, an OCB (optically compensated birefringence) mode, an ECB (electrically controlled birefringence) mode, an FLC (ferroelectric liquid crystal) mode, an AFLC (anti-ferroelectric liquid crystal) mode, a PDLC (polymer dispersed liquid crystal) mode, a PNLC (polymer network liquid crystal) mode, a guest-host mode, and the like. Alternatively, an IPS (in-plane-switching) mode, an FFS (fringe field switching) mode, an MVA (multi-domain vertical alignment) mode, a PVA (patterned vertical alignment) mode, an ASM (axially symmetric aligned micro-cell) mode, or the like can be used. Needless to say, there is no particular limitation on a liquid crystal material, a driving method, and an electrode structure in this embodiment as long as the liquid crystal element controls transmission or non-transmission of light by the optical modulation action.

Note that, although the alignment of liquid crystals in the liquid crystal element described as an example in this embodiment is controlled by a vertical electric field generated between the pixel electrode which is provided for the first substrate and the common electrode which is provided for the second substrate and faces the pixel electrode, the alignment of the liquid crystals may be controlled by a lateral electric field by changing the pixel electrode, depending on the liquid crystal material or the driving mode of a liquid crystal.

The terminal portion 126 is an input terminal for supplying certain signals (e.g., the high power supply potential Vdd, the low power supply potential Vss, the start pulse SP, the clock signal CK, and the image signal Data), the common potential Vcom, and the like which are output from the display control circuit 113, to the pixel driver circuit portion 121. The pixel driver circuit portion 121 includes the gate line driver circuit 121A and the source line driver circuit 121B. The gate line driver circuit 121A and the source line driver circuit 121B are driver circuits for driving the pixel portion 122 including the plurality of pixels and each include a shift register circuit (also referred to as a shift register).

Note that the gate line driver circuit 121A and the source line driver circuit 121B may be formed over the same substrate as the pixel portion 122 or may be formed over a different substrate from the substrate where the pixel portion 122 is formed.

The high power supply potential Vdd, the low power supply potential Vss, the start pulse SP, the clock signal CK, and the image signal Data which are controlled by the display control circuit 113 are supplied to the pixel driver circuit portion 121.

A transistor can be used as the switching element 127. A gate electrode of the switching element 127 is connected to a terminal 126A, and the switching element 127 supplies the common potential Vcom to the common electrode 128 through a terminal 126B in accordance with a control signal output from the display control circuit 113. A gate electrode and one of a source electrode and a drain electrode of the switching element 127 may be connected to the terminal portion 126 and the other of the source electrode and the drain electrode of the switching element 127 may be connected to the common electrode 128 so that the common potential Vcom is supplied from the power supply potential generation circuit 117 to the common electrode 128. Note that the switching element 127 may be formed over the same substrate as the pixel driver circuit portion 121 or the pixel portion 122 or may be formed over a different substrate from the substrate where the pixel driver circuit portion 121 or the pixel portion 122 are formed.

Further, for example, the transistor with less off-state current, which is described in Embodiment 3, is used as the switching element 127, whereby a reduction in potential applied to both terminals of the liquid crystal element 215 over time can be suppressed.

The common electrode 128 is electrically connected to a common potential line for supplying the common potential Vcom supplied from the power supply potential generation circuit 117 through the common connection portion.

As a specific example of the common connection portion, a conductive particle in which an insulating sphere is covered with a thin metal film is interposed between the common electrode 128 and the common potential line, whereby the common electrode 128 and the common potential line can be electrically connected to each other. Note that a plurality of common connection portions may be provided in the liquid crystal display panel 120.

Further, the liquid crystal display device may include a photometric circuit. The liquid crystal display device including the photometric circuit can detect the brightness of the environment where the liquid crystal display device is placed. When the photometric circuit detects that the liquid crystal display device is used in a dim environment, the display control circuit 113 controls light from the backlight 132 to increase the intensity of the light so that favorable visibility of the display screen is secured. In contrast, when the photometric circuit detects that the liquid crystal display device is used under extremely bright external light (e.g., under direct sunlight outdoors), the display control circuit 113 controls light from the backlight 132 to decrease the intensity of the light so that power consumption of the backlight 132 is reduced. Thus, the display control circuit 113 can control a driving method of a light source such as a backlight or a sidelight in accordance with a signal input from the photometric circuit.

The backlight portion 130 includes a backlight control circuit 131 and a backlight 132. The backlight 132 may be selected and combined in accordance with the use of the liquid crystal display device 100. For the backlight 132, a light-emitting diode (LED) or the like can be used. For example, white light-emitting element (e.g., a white LED) can be arranged in the backlight 132. A backlight signal for controlling the backlight and the power supply potential are supplied from the display control circuit 113 to the backlight control circuit 131. Needless to say, a reflective liquid crystal display panel which can perform display by using external light without using the backlight portion 130 is preferably used, in which case power consumption is low.

A region through which visible light is transmitted is provided in the backlight portion 130 and the pixel electrode of the liquid crystal display panel 120, whereby a transmissive liquid crystal display device or a transflective liquid crystal display device can be provided. The transmissive liquid crystal display device or the transflective liquid crystal display device is convenient because displayed images can be visually recognized even in a dim place.

Note that if needed, an optical film (e.g., a polarizing film, a retardation film, or an anti-reflection film) can be used in combination as appropriate. A light source such as a backlight which is used in a semi-transmissive liquid crystal display device may be selected and combined in accordance with the use of the liquid crystal display device 100, and a cold cathode tube, a light-emitting diode (LED), or the like can be used.

Further, a surface light source may be formed using a plurality of LED light sources or a plurality of electroluminescent (EL) light sources. As the surface light source, three or more kinds of LEDs may be used or an LED emitting white light may be used. Note that a color filter is not always provided in the case where light-emitting diodes of RGB or the like are arranged in a backlight and a successive additive color mixing method (a field sequential method) in which color display is performed by time division is employed. The use of the field sequential method in which a color filter which absorbs light of a backlight is not used makes it possible to reduce power consumption.

In the liquid crystal display device described as an example in this embodiment, the DC-DC converter can be stopped in a period in which the liquid crystal display panel holds one image. The capacitor in the backup circuit supplies the fixed potential to the liquid crystal display panel while the DC-DC converter is stopped; accordingly, the DC-DC converter does not consume power in an image holding period of the liquid crystal display panel, which is a load region with low conversion efficiency of the DC-DC converter, specifically, a region with an extremely small load. Thus, a display device in which power consumed in the image holding period is suppressed can be provided.

Further, the liquid crystal display device described as an example in this embodiment includes the backup circuit with the charging limiter. The capacitor in the backup circuit with the charging limiter is connected to the DC-DC converter through the limiter circuit; thus, even when the capacitor which is not filled with electric charge is connected to the DC-DC converter, a defect of the capacitor due to rapid charging can be prevented.

Note that this embodiment can be combined with any of the other embodiments described in this specification as appropriate.

Embodiment 2

In this embodiment, a driving method of a liquid crystal display device which includes a liquid crystal display panel driven with power supplied from a DC-DC converter or a backup circuit will be described with reference to FIG. 3, FIG. 4, FIGS. 5A and 5B, FIG. 6, FIG. 7, and FIG. 8.

Figure 2:
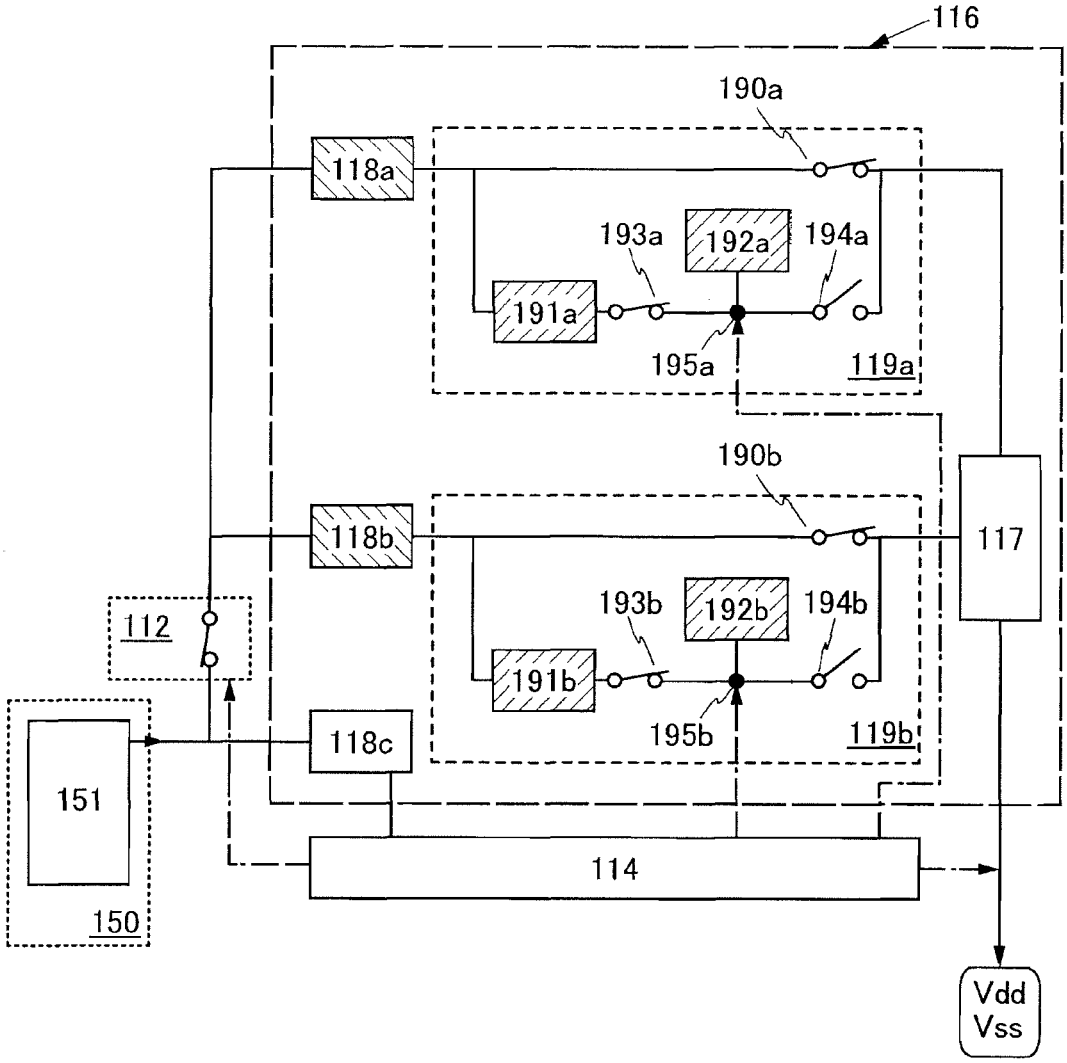
FIG. 2 is a block diagram illustrating a configuration of a power supply circuit according to Embodiment.

A driving method of the liquid crystal display device 100, which is illustrated in FIG. 1 as an example, will be described with reference to FIG. 3, FIG. 4, FIGS. 5A and 5B, and FIG. 6. The driving method of the liquid crystal display device, which is described in this embodiment, is a display method in which the frequency of image writing to the display panel is changed in accordance with properties of an image to be displayed, a fixed potential is supplied and the capacitor is charged with the use of the DC-DC converter in a writing operation where a load is large, and the fixed potential is preferentially supplied from the capacitor without using the DC-DC converter in an image holding period when the load is small.

Specifically, in the case where image signals in successive frames are different from each other (i.e., a moving image is displayed), a display mode is employed in which an image signal is written to every frame. On the other hand, in the case where image signals in successive frames are the same (i.e., a still image is displayed), a display mode is employed in which writing of image signals is not performed or the writing frequency is extremely reduced in a period in which one image is being displayed; the voltage applied to the liquid crystal element is held by setting potentials of the pixel electrode and the common electrode which apply the voltage to the liquid crystal element in a floating state, so that a still image is displayed without additional potential supply.

Further, the fixed potential is supplied and the capacitor is charged with the use of the DC-DC converter in the writing operation where the load is large, while power supply to the DC-DC converter is stopped and the fixed potential is preferentially supplied from the capacitor in the period in which one image is being displayed.

Note that the liquid crystal display device displays a moving image and a still image in combination. The moving image refers to an image which is recognized as a moving image by human eyes by rapid switching of a plurality of different images which are time-divided into a plurality of frames. Specifically, by switching images at least 60 times (60 frames) per second, the images are recognized as a moving image with less flicker by human eyes. In contrast, unlike the moving image and a partial moving image, the still image refers to an image which does not change in successive frame periods, for example, between an n-th frame and an (n+1)-th frame even though a plurality of images which are time-divided into a plurality of frame periods are switched at high speed.

First, power is supplied to the liquid crystal display device 100. The power supply potential generation circuit 117 supplies a common potential Vcom and supplies power supply potentials (a high power supply potential Vdd and a low power supply potential Vss) and control signals (a start pulse SP and a clock signal CK) to the liquid crystal display panel 120 through the display control circuit 113.

The arithmetic circuit 114 of the liquid crystal display device 100 analyzes electronic data to be displayed. Here, the case will be described where the electronic data includes data for a moving image and data for a still image, and the arithmetic circuit 114 determines whether the data is for a moving image or a still image, so that different signals are output for the moving image and the still image.

When the electronic data displayed by the arithmetic circuit 114 is switched from data for a moving image to data for a still image, the arithmetic circuit 114 can extract data for a still image from the electronic data and outputs the extracted data, as well as a control signal which indicates that the extracted data is for a still image, to the signal generation circuit 115*a* and the liquid crystal driver circuit 115*b*. Moreover, when the electronic data is switched from data for a still image to data for a moving image, the arithmetic circuit 114 outputs an image signal including the data for a moving image, as well as a control signal which indicates that the image signal is for a moving image, to the signal generation circuit 115*a* and the liquid crystal driver circuit 115*b*.

Figure 3:
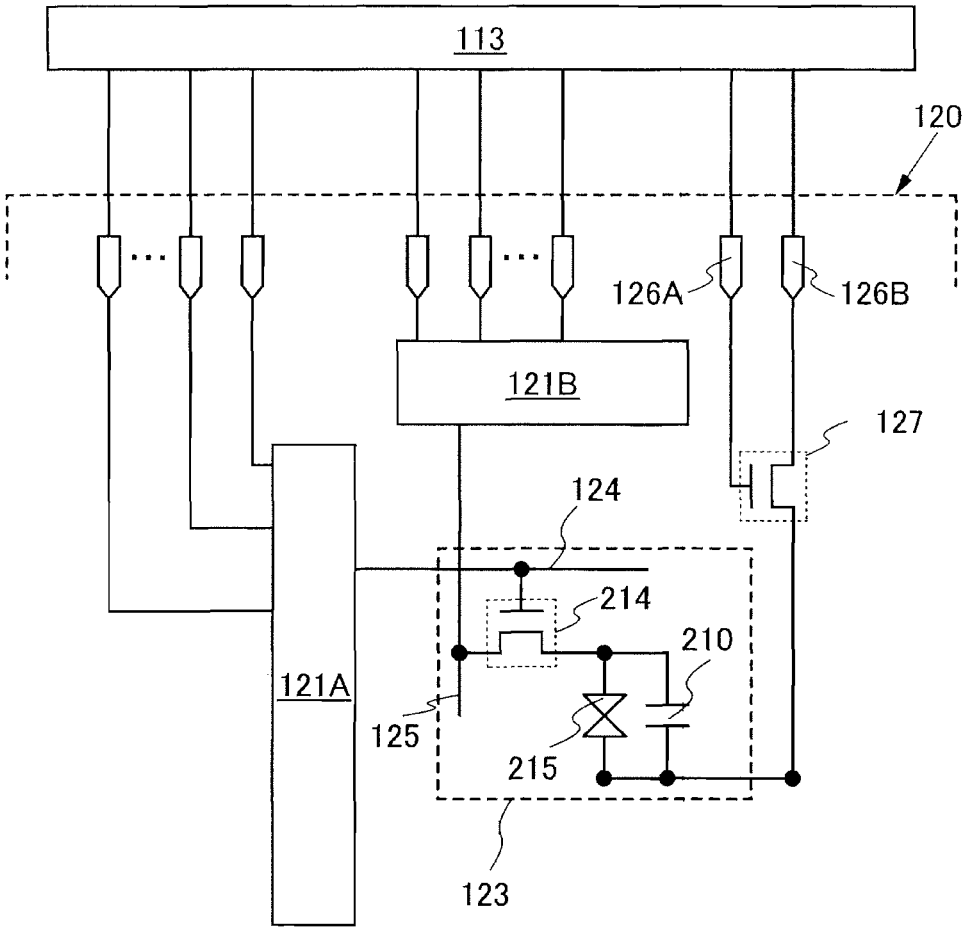
FIG. 3 is an equivalent circuit diagram illustrating a structure of a liquid crystal display panel according to Embodiment.

Next, the states of signals supplied to the pixels will be described with reference to FIG. 3 which is an equivalent circuit diagram of the liquid crystal display device and FIG. 4 which is a timing chart thereof.

Figure 4:
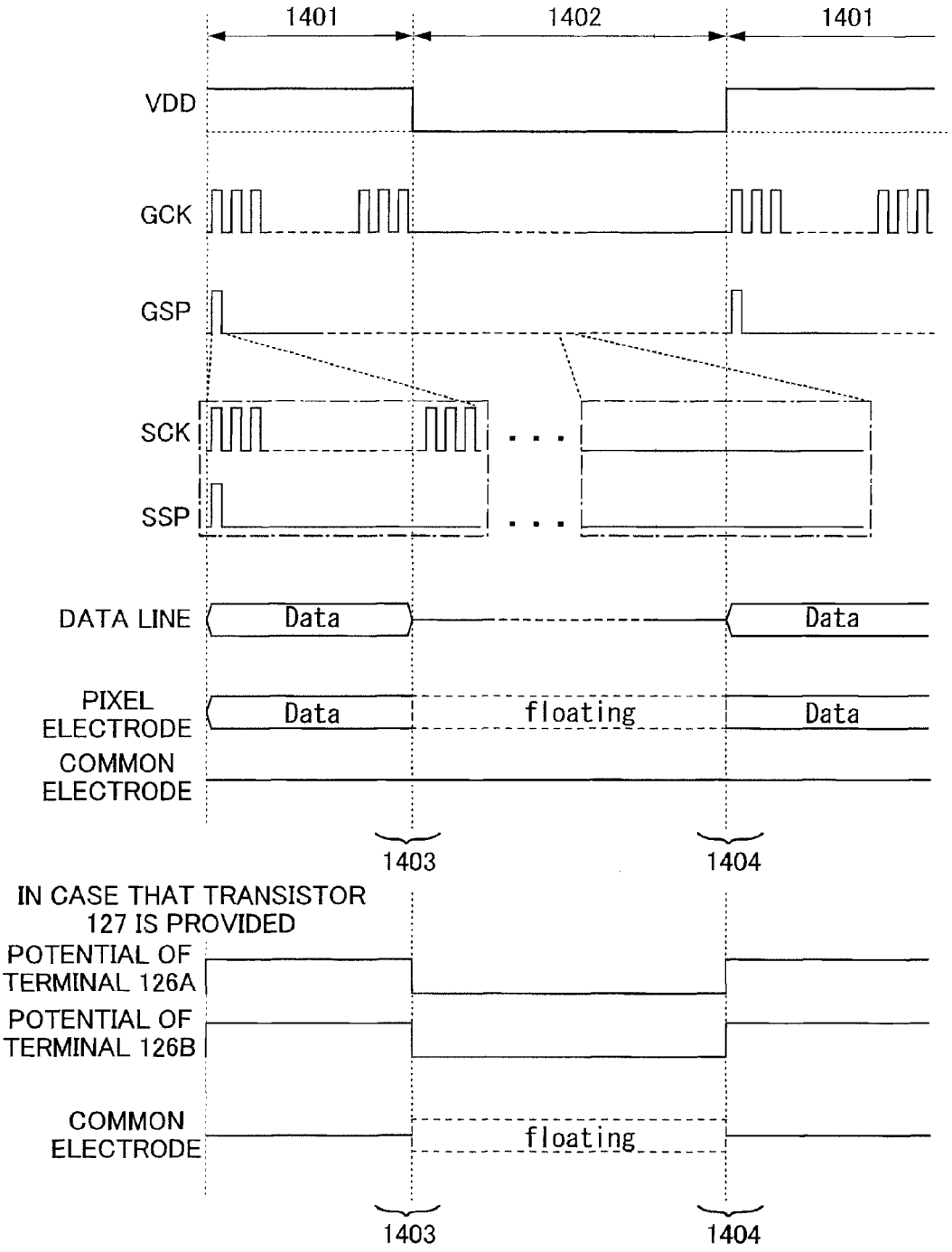
FIG. 4 is a timing chart showing a driving method of the liquid crystal display device according to Embodiment.

FIG. 4 shows a clock signal GCK and a start pulse GSP which are supplied to the gate line driver circuit 121A by the display control circuit 113. In addition, a clock signal SCK and a start pulse SSP which are supplied to the source line driver circuit 121B by the display control circuit 113 are shown. Note that, for the description of the timing at which the clock signal is output, the wavelength of the clock signal is shown by a simple rectangular wave in FIG. 4.

Further, Data line, the potential of the pixel electrode, and the potential of the common electrode are shown in FIG. 4. Note that the potential of the source line 125, the potential of the pixel electrode, the potential of the terminal 126A, the potential of the terminal 126B, and the potential of the common electrode are shown for the case where the switching element 127 is provided.

In FIG. 4, a period 1401 corresponds to a period in which image signals for displaying a moving image are written. In the period 1401, an operation is performed so that image signals are supplied to the pixels in the pixel portion 122 and the common potential is supplied to the common electrode. In addition, since a writing operation where a load is large continues, the fixed potential is supplied and the capacitor is charged with the use of the DC-DC converter.

A period 1402 corresponds to a period in which a still image is displayed (also referred to as an image holding period). In the period 1402, supply of image signals Data to the pixels in the pixel portion 122 is stopped, a potential at which the pixel transistor is turned off is supplied to the gate line, and the common potential is supplied to the common electrode 128. Note that in the image holding period 1402 in which the load is small, the fixed potential is preferentially supplied from the capacitor. Note that, although the structure of FIG. 4 shows that each signal is supplied so that the signal generation circuit 115*a* and the liquid crystal driver circuit 115*b* stop operating in the period 1402, it is preferable to employ a structure in which image signals are regularly written in accordance with the length of the period 1402 and the refresh rate to prevent deterioration of a still image.

First, the timing chart in the period 1401 in which image signals for displaying a moving image are written will be described. In the period 1401, a clock signal is constantly supplied as the clock signal GCK, and a pulse in accordance with a vertical synchronizing frequency is supplied as the start pulse GSP. In the period 1401, a clock signal is constantly supplied as the clock signal SCK, and a pulse in accordance with one gate selection period is supplied as the start pulse SSP.

An image signal Data is supplied to pixels in each row through the source line 125, and a potential of the source line 125 is supplied to the pixel electrode in accordance with a potential of a gate line 124.

Further, a potential at which the switching element 127 is turned on is supplied from the display control circuit 113 to the terminal 126A of the switching element 127, so that the common potential is supplied to the common electrode through the terminal 126B.

Next, the timing chart in the period 1402 in which a still image is displayed will be described. In the period 1402, supply of all of the clock signal GCK, the start pulse GSP, the clock signal SCK, and the start pulse SSP is stopped. In addition, supply of the image signal Data to the source line 125 is stopped in the period 1402. In the period 1402 in which supply of the clock signal GCK and the start pulse GSP is stopped, the transistor 214 is turned off and the potential of the pixel electrode is brought into the floating state.

Also in the period 1402, the power supply potential generation circuit 117 supplies the common potential Vcom to the common electrode 128, and the liquid crystal element 215 which includes the liquid crystal layer between the pixel electrode the potential of which is in a floating state and the common electrode 128 the potential of which is the common potential Vcom can stably hold a still image. Further, at this time, the fixed potential is preferentially supplied from the capacitor without using the DC-DC converter, whereby power consumed in the image holding period can be reduced.

In the case where the liquid crystal display panel includes the switching element 127, the display control circuit 113 supplies a potential at which the switching element 127 is turned off to the terminal 126A of the switching element 127, so that the potential of the common electrode 128 can be brought into a floating state.

In the period 1402, the potentials of the electrodes at opposite ends of the liquid crystal element 215, that is, the pixel electrode and the common electrode are brought into a floating state, whereby a still image can be displayed. In the case where the switching element 127 is provided, the power supply potential generation circuit 117 does not need to supply the common potential Vcom to the common electrode 128 in the period 1402, and thus can stop generating the common potential Vcom. Generation of the common potential Vcom is preferably controlled with the use of the arithmetic circuit 114, in which case power consumption can be further reduced.

Further, supply of a clock signal and a start pulse to the gate line driver circuit 121A and the source line driver circuit 121B are stopped, whereby low power consumption can be achieved. Moreover, supply of power to the DC-DC converters is stopped, and the fixed potentials are output from the capacitors in the first backup circuit 119*a* and the second backup circuit 119*b* to the liquid crystal display panel 120 through the power supply potential generation circuit 117; thus, standby power of the DC-DC converters can be reduced.

In particular, a transistor having reduced off-state current is preferably used as the transistor 214 and the switching element 127, in which case a decrease in the voltage applied to both terminals of the liquid crystal element 215 over time can be suppressed.

Figure 5A:
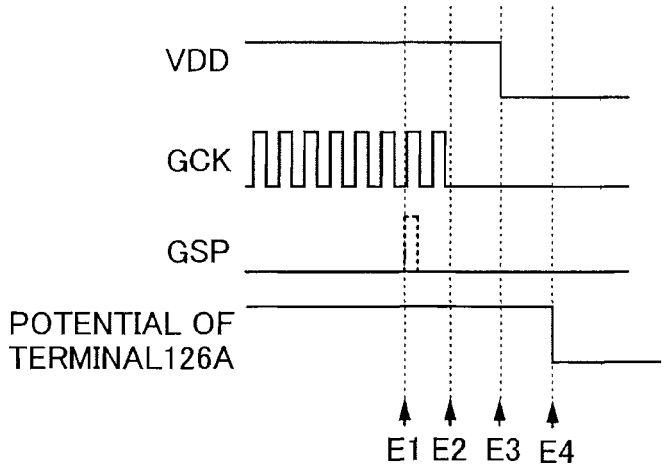
FIGS. 5A and 5B are timing charts showing driving methods of the liquid crystal display device according to Embodiment.
Figure 5B:
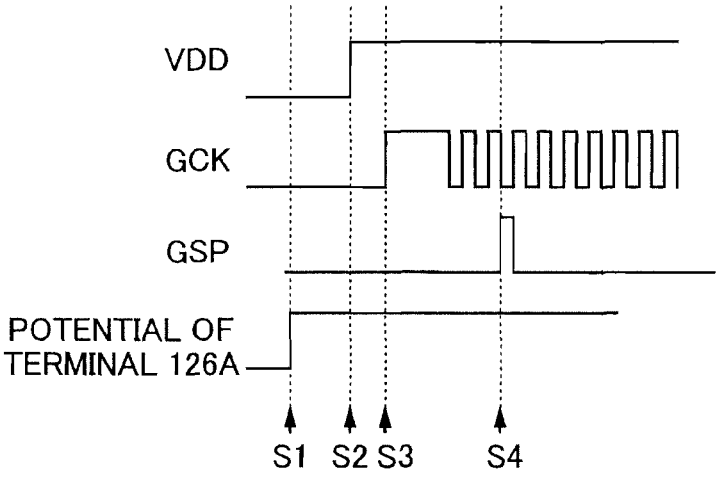

Next, operations of the display control circuit in a period in which a moving image is switched to a still image (a period 1403 in FIG. 4) and in a period in which a still image is switched to a moving image or a still image is rewritten (a period 1404 in FIG. 4) will be described with reference to FIGS. 5A and 5B. FIGS. 5A and 5B show the high power supply potential Vdd, the clock signal (here, GCK), the start pulse signal (here, GSP) which are output from the display control circuit, and the potential of the terminal 126A.

FIG. 5A shows the operation of the display control circuit in the period 1403 in which a moving image is switched to a still image. The display control circuit stops the supply of the start pulse GSP (E1 in FIG. 5A: a first step). The supply of the start pulse GSP is stopped, and then the supply of a plurality of clock signals GCK is stopped after pulse output reaches the last stage of the shift register (E2 in FIG. 5A: a second step). Then, the high power supply potential Vdd that is a power supply potential is changed to the low power supply potential Vss (E3 in FIG. 5A: a third step).

After that, in the case where the liquid crystal display panel 120 includes the switching element 127, the potential of the terminal 126A is changed to a potential at which the switching element 127 is turned off (E4 in FIG. 5A: a fourth step). Further, the arithmetic circuit 114 can control the power supply potential generation circuit 117 to stop generation of the common potential Vcom.

Through the above steps, the supply of the signals to the pixel driver circuit portion 121 can be stopped without causing a malfunction of the pixel driver circuit portion 121. Since a malfunction generated when the displayed image is switched from a moving image to a still image causes noise and the noise is held as a still image, a liquid crystal display device mounted with a display control circuit with few malfunctions can display a still image with less image deterioration.

Next, operation of the display control circuit in the period 1404 in which a displayed image is switched from a still image to a moving image or a still image is rewritten is shown in FIG. 5B. In the case where the liquid crystal display panel 120 includes the switching element 127, the display control circuit changes the potential of the terminal 126A to a potential at which the switching element 127 is turned on (S1 in FIG. 5B: a first step).

Next, regardless of whether the switching element 127 is provided, the power supply potential is changed from the low power supply potential Vss to the high power supply potential Vdd (S2 in FIG. 5B: a second step). Then, a high potential of a pulse signal which has a longer pulse width than the normal clock signal GCK to be supplied later is applied as the clock signal GCK, and then a plurality of normal clock signals GCK are supplied (S3 in FIG. 5B: a third step). Next, the start pulse signal GSP is supplied (S4 in FIG. 5B: a fourth step).

Through the above steps, the supply of drive signals to the pixel driver circuit portion 121 can be resumed without causing a malfunction of the pixel driver circuit portion 121. Potentials of the wirings are sequentially brought back to those at the time of displaying a moving image as appropriate, whereby the pixel driver circuit portion 121 can be driven without causing a malfunction.

Figure 6:
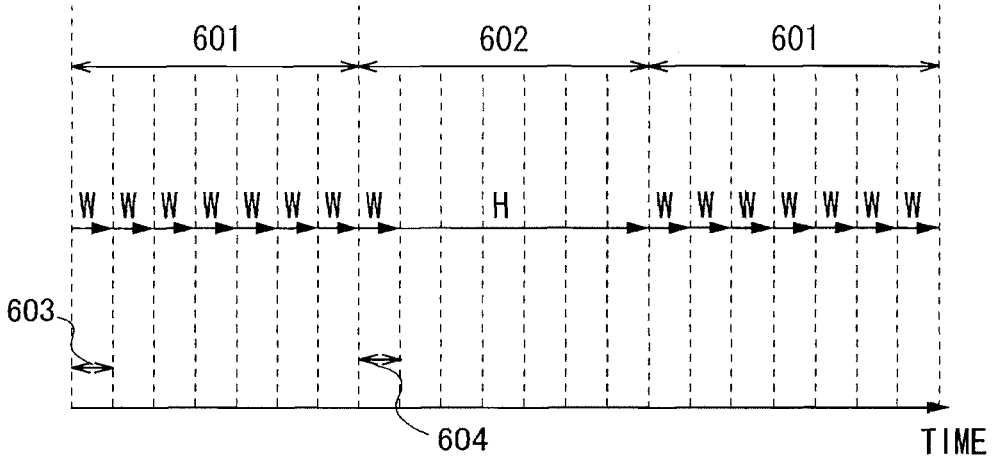
FIG. 6 is a timing chart showing a driving method of the liquid crystal display device according to Embodiment.

FIG. 6 schematically shows writing frequency of image signals in each frame period in a period 601 in which a moving image is displayed or in a period 602 in which a still image is displayed. In FIG. 6, "W" indicates a period in which an image signal is written, and "H" indicates a period in which the image signal is held. In addition, a period 603 in FIG. 6 is one frame period; however, the period 603 may be a different period.

Thus, in the structure of the liquid crystal display device of this embodiment, an image signal for a still image to be displayed in the period 602 is written in a period 604, and the image signal written in the period 604 is held in the other period in the period 602.

Figure 7:
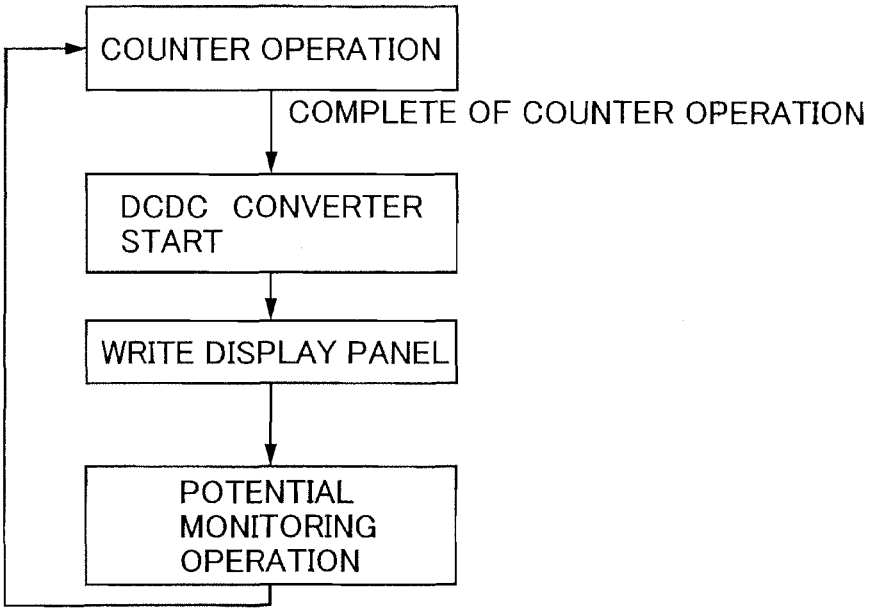
FIG. 7 is a diagram illustrating a driving method of the power supply circuit according to Embodiment.
Figure 8:
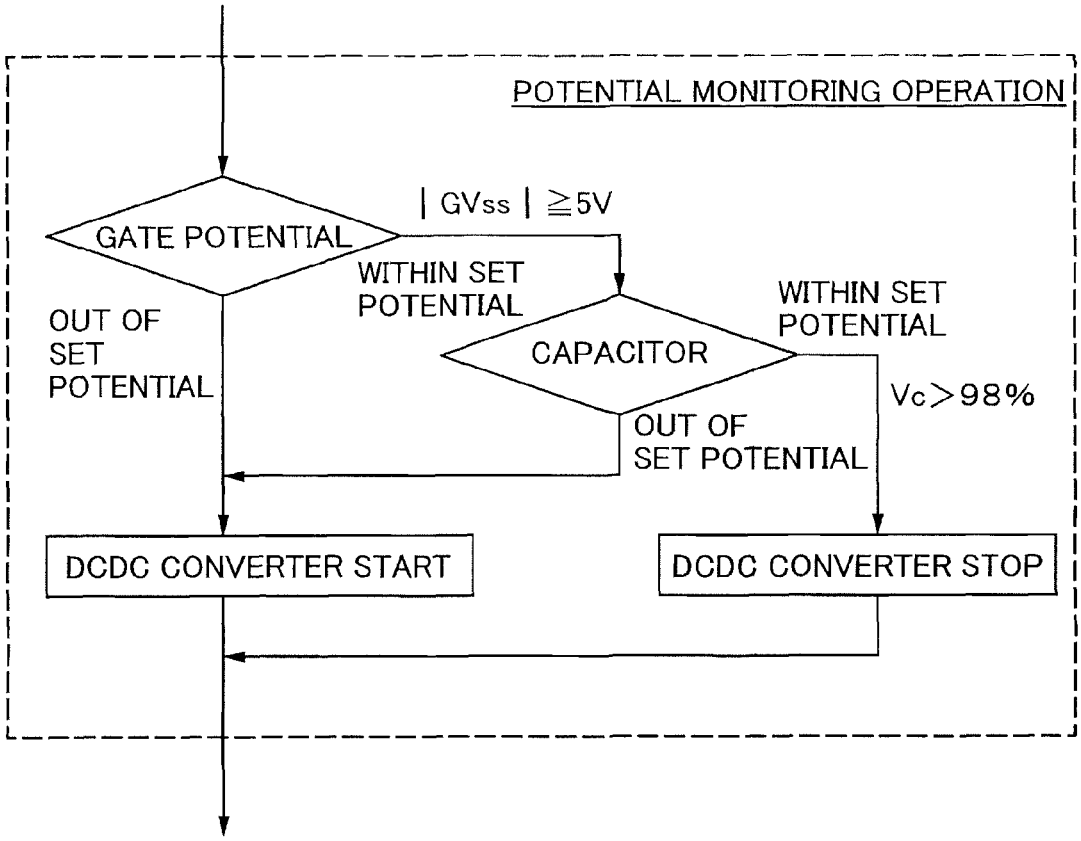
FIG. 8 is a diagram illustrating a driving method of the power supply circuit according to Embodiment.

Next, a driving method of the power supply circuit 116 will be described with reference to FIG. 7 and FIG. 8. In the liquid crystal display device 100 described as an example in this embodiment, in addition to changing the frequency of image writing to the display panel 120 in accordance with properties of an image to be displayed, the fixed potential is supplied and the capacitor is charged with the use of the DC-DC converter in the writing operation where a load is large, and the fixed potential is preferentially supplied from the capacitor without using the DC-DC converter in the image holding period that the load is small.

In a moving image display period in which images are frequently written, the fixed potential is supplied from the power supply portion 150 to the liquid crystal display panel 120 through the DC-DC converters and the power supply potential generation circuit 117, and the capacitors in the first backup circuit 119*a* and the second backup circuit 119*b* may be charged. Note that a DC-DC converter which has high conversion efficiency in a state where a load for writing an image to the liquid crystal display panel 120 and a load for charging the capacitor are connected may be used as the DC-DC converter.

When the amount of charging of each of the capacitors in the first backup circuit 119*a* and the second backup circuit 119*b* is too low, the capacitor is connected to the DC-DC converter, in which case a reduction in output potential of the DC-DC converter is caused; thus, a defect in which the power supply potential generation circuit 117 cannot output an appropriate fixed potential to the liquid crystal display panel is caused. The backup circuit of one embodiment of the present invention includes the limiter circuit, and the limiter circuit limits current flowing into the capacitor, so that a defect of the capacitor caused by rapid charging can be prevented.

A driving method of the power supply circuit in a period in which the frequency of image writing is low, which is typified by a still image display period (also referred to as an image holding period) will be described with reference to the flow chart of FIG. 7.

In the image holding period, a still image is displayed on the liquid crystal display panel 120, and the arithmetic circuit 114 regularly (e.g., every several seconds) monitors the state of the display device while counting time (this operation is referred to as a counter operation). Specifically, the arithmetic circuit 114 monitors the potentials of the capacitors in the first backup circuit 119*a* and the second backup circuit 119*b* and the gate potential of the pixel transistor. Note that the detail of the monitoring operation will be described later.

In the case where an instruction to write an image is given by the input device 160 in the counter operation, the arithmetic circuit 114 reads electronic data from the memory device 140, and the counter operation is stopped.

Next, the arithmetic circuit 114 connects the power supply portion 150 to the first DC-DC converter 118*a* and the second DC-DC converter 118*b* with the use of the switching circuit 112, so that power is supplied to the liquid crystal display panel 120 through the power supply potential generation circuit 117.

The arithmetic circuit 114 converts the electronic data into an image signal and writes image data to the liquid crystal display panel 120 with the use of power supplied from the first DC-DC converter 118*a* and the second DC-DC converter 118*b*. After the writing, the arithmetic circuit 114 monitors the state of the display device.

Next, the counter operation starts. Time to be counted is set corresponding to intervals of automatic writing of display image data and may be set at several seconds to several tens minutes. In particular, the time to be counted is preferably longer than or equal to 10 seconds and shorter than or equal to 600 seconds. When the time to be counted is set longer than or equal to 10 seconds, a pronounced effect of reducing power consumption can be obtained, and when the time to be counted is set shorter than or equal to 600 seconds, decline of the quality of a held image can be prevented.

Note that the arithmetic circuit 114 receives power from the third DC-DC converter 118*c* which is constantly connected to the power supply portion 150, and thus can respond to an interrupt instruction by a user or the like without delay. The arithmetic circuit 114 may move to a sleep mode during the time counter operation, so that power consumption can be further reduced.

The monitoring operation of the arithmetic circuit 114 will be described with reference to the flow chart of FIG. 8. The arithmetic circuit 114 regularly monitors the state of the display device in the time counter operation and controls an operation of connecting the power supply portion 150 to the first DC-DC converter 118*a* and the second DC-DC converter 118*b* with the use of the switching circuit 112.

The arithmetic circuit 114 regularly (e.g., every several seconds) checks the gate potential of the pixel transistor, and connects the power supply portion 150 to the first DC-DC converter 118*a* and the second DC-DC converter 118*b* with the use of the switching circuit 112 when the absolute value of the gate potential of the pixel transistor is smaller than a set potential. The gate potential of the pixel transistor can be known with reference to the potential of a wiring electrically connected to the gate electrode of the pixel transistor. The set potential may be, for example, 5 V or more in an absolute value. The absolute value of the set potential may be set so that the off-state current of the pixel transistor in a state of holding an image becomes sufficiently low and the transistor can be prevented from being accidentally turned on due to noise or the like. Specifically, the gate potential of the pixel transistor may be maintained at −5 V or lower in the case where a normally-off n-channel transistor whose threshold voltage Vth is approximately 0 V and in which an oxide semiconductor layer is used in a channel formation region is used as the pixel transistor.

In a state where power is not supplied to the first DC-DC converter 118*a* and the second DC-DC converter 118*b*, the output potentials of the capacitors in the first backup circuit 119*a* and the second backup circuit 119*b* affect the absolute value of the gate potential of the pixel transistor. The capacitor in the first backup circuit 119*a* or the second backup circuit 119*b* discharges due to leakage current generated in the circuits included in the liquid crystal display device 100, so that the output potential of the capacitor is decreased.

Thus, in the case where the amount of charging of the capacitors in the first backup circuit 119*a* and the second backup circuit 119*b* is insufficient and the absolute value of the gate potential of the pixel transistor is smaller than the value of the set potential, the arithmetic circuit 114 connects the power supply portion 150 to the first DC-DC converter 118*a* and the second DC-DC converter 118*b* with the use of the switching circuit 112, so that the absolute value of the gate potential of the pixel transistor can be maintained larger than the value of the set potential with the use of the power supply potential generation circuit 117.

Further, the arithmetic circuit 114 regularly checks the potentials of the capacitors in the first backup circuit 119*a* and the second backup circuit 119*b*, and disconnects the first DC-DC converter 118*a* and the second DC-DC converter 118*b* from the power supply portion 150 by using the switching circuit 112 when the potential of each of the capacitors is higher than the set potential. As the set potential, for example, approximately 98% of the output potential of the first DC-DC converter 118*a* or the second DC-DC converter 118*b* to which the capacitor is connected is preferable.

The set potential is approximately 98% of the output potential of the first DC-DC converter 118*a* or the second DC-DC converter 118*b* to which the capacitor is connected, whereby power consumption can be reduced while a load of the converter is being set in the range which does not cause a problem in actual use.

In the liquid crystal display device described as an example in this embodiment, the DC-DC converter can be stopped in a period in which the liquid crystal display panel holds one image. The capacitor in the backup circuit supplies the fixed potential to the liquid crystal display panel while the DC-DC converter is stopped; accordingly, the DC-DC converter does not consume power in an image holding period of the liquid crystal display panel, which is a load region with low conversion efficiency of the DC-DC converter, specifically, a region with an extremely small load. Thus, a display device in which power consumed in the image holding period is suppressed can be provided.

Further, the liquid crystal display device described as an example in this embodiment includes the backup circuit with a charging limiter. The capacitor in the backup circuit with the charging limiter is connected to the DC-DC converter through the limiter circuit; thus, even when the capacitor which is not filled with charge is connected to the DC-DC converter, a defect of the capacitor due to rapid charging can be prevented.

In particular, transistors with less off-state current are used for each pixel and a switching element of the common electrode in the liquid crystal display device of this embodiment, whereby potential can be held in a storage capacitor for a long period (time). Thus, the frequency of writing image signals can be remarkably reduced, resulting in a significant reduction in power consumption at the time of displaying a still image and considerably less eyestrain.

Note that this embodiment can be combined with any of the other embodiments described in this specification as appropriate.

Embodiment 3

In this embodiment, an example of a transistor including an oxide semiconductor layer, which is used for the liquid crystal display device described in Embodiment 1 or 2, and an example of a manufacturing method of the transistor will be described in detail with reference to FIGS. 9A to 9E. The same portions as those in the above embodiments and portions having functions similar to those of the portions in the above embodiments and steps similar to those in the above embodiments may be handled as in the above embodiments, and repeated description is omitted. In addition, detailed description of the same portions is also omitted.

FIGS. 9A to 9E illustrate an example of a cross-sectional structure of a transistor. A transistor 510 illustrated in FIGS. 9A to 9E is an inverted staggered transistor with a bottom gate structure, which can be used in the liquid crystal display device described in Embodiment 1 or 2. In a transistor which includes an oxide semiconductor layer described in this embodiment in a channel formation region, current flowing between a source electrode and a drain electrode at the time when the transistor is off is extremely low. Thus, by using the transistor as the pixel transistor of the liquid crystal display panel, deterioration of image data written to the pixel in an image holding period can be suppressed.

Steps of manufacturing the transistor 510 over a substrate 505 will be described below with reference to FIGS. 9A to 9E.

First, a conductive film is formed over the substrate 505 having an insulating surface, and then a gate electrode layer 511 is formed in a first photolithography step. Note that a resist mask may be formed by an inkjet method. Formation of the resist mask by an inkjet method needs no photomask; thus, the manufacturing cost can be reduced.

In this embodiment, a glass substrate is used as the substrate 505 having an insulating surface.

An insulating film which serves as a base film may be provided between the substrate 505 and the gate electrode layer 511. The base film has a function of preventing diffusion of impurity elements from the substrate 505 and can be formed to have a single-layer structure or a stacked-layer structure using a silicon nitride film, a silicon oxide film, a silicon nitride oxide film, and/or a silicon oxynitride film.

The gate electrode layer 511 can be formed to have a single-layer structure or stacked-layer structure using a metal material such as molybdenum, titanium, tantalum, tungsten, aluminum, copper, neodymium, or scandium, or an alloy which contains any of these materials as a main component.

Next, a gate insulating layer 507 is formed over the gate electrode layer 511. The gate insulating layer 507 can be formed to have a single-layer structure or a stacked-layer structure using a silicon oxide layer, a silicon nitride layer, a silicon oxynitride layer, a silicon nitride oxide layer, an aluminum oxide layer, an aluminum nitride layer, an aluminum oxynitride layer, an aluminum nitride oxide layer and/or a hafnium oxide layer by a plasma CVD method, a sputtering method, or the like.

As the oxide semiconductor in this embodiment, an oxide semiconductor which is made to be an i-type semiconductor or a substantially i-type semiconductor by removing impurities is used. Such a purified oxide semiconductor is highly sensitive to an interface state and interface charge; thus, an interface between the oxide semiconductor layer and the gate insulating layer is important. For that reason, the gate insulating layer that is to be in contact with a purified oxide semiconductor needs to have high quality.

For example, a high-density plasma CVD method using microwaves (e.g., a frequency of 2.45 GHz) is preferably used, in which case an insulating layer which is dense and has high withstand voltage and high quality can be formed. The purified oxide semiconductor and the high-quality gate insulating layer are in close contact with each other, whereby the interface state density can be reduced and favorable interface characteristics can be obtained.

Needless to say, another film formation method such as a sputtering method or a plasma CVD method can be employed as long as the method enables formation of a high-quality insulating layer as the gate insulating layer. Further, an insulating layer whose film quality and characteristic of the interface between the insulating layer and an oxide semiconductor are improved by heat treatment which is performed after formation of the insulating layer may be formed as the gate insulating layer. In any case, any insulating layer may be formed as long as the insulating layer has characteristics of enabling a reduction in interface state density of the interface between the insulating layer and an oxide semiconductor and formation of a favorable interface as well as having favorable film quality as a gate insulating layer.

Further, in order that hydrogen, hydroxyl group, and moisture are contained as little as possible in the gate insulating layer 507 and an oxide semiconductor film 530, it is preferable that the substrate 505 over which the gate electrode layer 511 is formed or the substrate 505 over which the gate electrode layer 511 and the gate insulating layer 507 are formed be preheated in a preheating chamber of a sputtering apparatus as pretreatment for the formation of the oxide semiconductor film 530 to eliminate and remove impurities such as hydrogen and moisture adsorbed on the substrate 505. As an exhaustion unit provided in the preheating chamber, a cryopump is preferable. Note that this preheating treatment can be omitted. Further, this preheating treatment may be performed in a similar manner on the substrate 505 over which layers up to and including a source electrode layer 515*a* and a drain electrode layer 515*b* are formed before formation of an insulating layer 516.

Figure 9A:
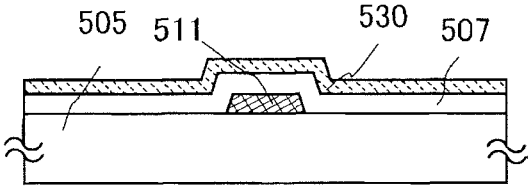
FIGS. 9A to 9E illustrate a manufacturing method of a transistor according to Embodiment.
Figure 9B:
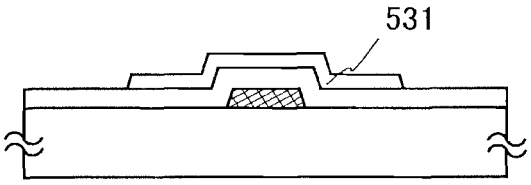

Next, the oxide semiconductor film 530 with a thickness greater than or equal to 2 nm and less than or equal to 200 nm, preferably greater than or equal to 5 nm and less than or equal to 30 nm, is formed over the gate insulating layer 507 (see FIG. 9A).

Note that before the oxide semiconductor film 530 is formed by a sputtering method, powdery substances (also referred to as particles or dust) attached to a surface of the gate insulating layer 507 are preferably removed by reverse sputtering in which plasma is generated by introduction of an argon gas. The reverse sputtering refers to a method in which an RF power supply is used for application of voltage to a substrate side in an argon atmosphere and plasma is generated around the substrate to modify a surface. Note that instead of an argon atmosphere, a nitrogen atmosphere, a helium atmosphere, an oxygen atmosphere, or the like may be used.

As an oxide semiconductor used for the oxide semiconductor film 530, the following metal oxide can be used: a four-component metal oxide such as an In—Sn—Ga—Zn—O-based oxide semiconductor; a three-component metal oxide such as an In—Ga—Zn—O-based oxide semiconductor, an In—Sn—Zn—O-based oxide semiconductor, an In—Al—Zn—O-based oxide semiconductor, a Sn—Ga—Zn—O-based oxide semiconductor, an Al—Ga—Zn—O-based oxide semiconductor, a Sn—Al—Zn—O-based oxide semiconductor; a two-component metal oxide such as an In—Zn—O-based oxide semiconductor, a Sn—Zn—O-based oxide semiconductor, an Al—Zn—O-based oxide semiconductor, a Zn—Mg—O-based oxide semiconductor, a Sn—Mg—O-based oxide semiconductor, an In—Mg—O-based oxide semiconductor, an In—Ga—O-based oxide semiconductor; an In—O-based oxide semiconductor, a Sn—O based oxide semiconductor, a Zn—O-based oxide semiconductor, or the like. Further, $SiO_2$ may be contained in the above oxide semiconductor. Here, for example, an In—Ga—Zn—O-based oxide semiconductor means an oxide film containing indium (In), gallium (Ga), and zinc (Zn), and there is no particular limitation on the stoichiometric proportion thereof. The In—Ga—Zn—O-based oxide semiconductor may contain an element other than In, Ga, and Zn. In this embodiment, the oxide semiconductor film 530 is deposited by a sputtering method with the use of an In—Ga—Zn—O-based oxide semiconductor target. A cross-sectional view at this stage corresponds to FIG. 9A.

As the target for forming the oxide semiconductor film 530 by a sputtering method, for example, an oxide target having a composition ratio of $In_2O_3$:$Ga_2O_3$:ZnO=1:1:1 [molar ratio] is used to form an In—Ga—Zn—O film. Without limitation on the material and the component of the target, for example, an oxide target having a composition ratio of $In_2O_3$:$Ga_2O_3$:ZnO=1:1:2 [molar ratio] may be used.

Furthermore, the filling rate of the oxide target is 90% to 100%, and in some embodiments 95% to 99.9%. With the use of the oxide target with a high filling rate, a dense oxide semiconductor film can be formed.

It is preferable that a high-purity gas from which impurities such as hydrogen, water, hydroxyl group, or hydride have been removed be used as a sputtering gas used for the formation of the oxide semiconductor film 530.

The substrate is held in a deposition chamber kept under reduced pressure, and the substrate temperature is set to temperatures higher than or equal to 100° C. and lower than or equal to 600° C., preferably higher than or equal to 200° C. and lower than or equal to 400° C. By forming the oxide semiconductor film while the substrate is heated, the concentration of impurities contained in the formed oxide semiconductor film can be reduced. In addition, damage due to the sputtering can be reduced. Then, a sputtering gas from which hydrogen and moisture have been removed is introduced into the deposition chamber while moisture remaining therein is removed, and the oxide semiconductor film 530 is formed over the substrate 505 with the use of the above target. In order to remove moisture remaining in the deposition chamber, an entrapment vacuum pump such as a cryopump, an ion pump, or a titanium sublimation pump is preferably used. The evacuation unit may be a turbo pump provided with a cold trap. In the deposition chamber which is evacuated with the cryopump, a hydrogen atom, a compound containing a hydrogen atom, such as water ($H_2O$), (more preferably, also a compound containing a carbon atom), and the like are removed, whereby the concentration of impurities in the oxide semiconductor film formed in the deposition chamber can be reduced.

The atmosphere for the sputtering method may be a rare gas (typically, argon) atmosphere, an oxygen atmosphere, or a mixed atmosphere of a rare gas and oxygen.

As one example of the deposition condition, the distance between the substrate and the target is 100 mm, the pressure is 0.6 Pa, the direct-current (DC) power source is 0.5 kW, and the atmosphere is an oxygen atmosphere (the proportion of the oxygen flow rate is 100%). Note that a pulsed direct-current power source is preferably used, in which case powder substances (also referred to as particles or dust) that are generated in deposition can be reduced and the film thickness can be uniform.

Next, the oxide semiconductor film 530 is processed into an island-shaped oxide semiconductor layer in a second photolithography step. A resist mask for forming the island-shaped oxide semiconductor layers may be formed by an inkjet method. Formation of the resist mask by an inkjet method needs no photomask; thus, the manufacturing cost can be reduced.

In the case where a contact hole is formed in the gate insulating layer 507, a step of forming the contact hole can be performed at the same time as processing of the oxide semiconductor film 530.

Note that for the etching of the oxide semiconductor film 530, one of or both wet etching and dry etching may be employed. As an etchant used for wet etching for the oxide semiconductor film 530, for example, a mixed solution of phosphoric acid, acetic acid, and nitric acid, or the like can be used. In addition, ITO07N (produced by KANTO CHEMICAL CO., INC.) may be used.

Next, first heat treatment is performed on the oxide semiconductor layer. The oxide semiconductor layer can be dehydrated or dehydrogenated through this first heat treatment. The temperature of the first heat treatment is higher than or equal to 400° C. and lower than or equal to 750° C., preferably higher than or equal to 400° C. and lower than the strain point of the substrate. Here, the substrate is put in an electric furnace which is a kind of heat treatment apparatus and heat treatment is performed on the oxide semiconductor layer at 450° C. for one hour in a nitrogen atmosphere, and then the oxide semiconductor layer is not exposed to the air so that entry of water or hydrogen into the oxide semiconductor layer is prevented; thus, an oxide semiconductor layer 531 is obtained (see FIG. 9B).

Note that a heat treatment apparatus is not limited to an electric furnace, and a device for heating an object to be processed by heat conduction or heat radiation from a heating element such as a resistance heating element may be alternatively used. For example, a rapid thermal anneal (RTA) apparatus such as a gas rapid thermal anneal (GRTA) apparatus or a lamp rapid thermal anneal (LRTA) apparatus can be used. An LRTA apparatus is an apparatus for heating an object to be processed by radiation of light (an electromagnetic wave) emitted from a lamp such as a halogen lamp, a metal halide lamp, a xenon arc lamp, a carbon arc lamp, a high pressure sodium lamp, or a high pressure mercury lamp A GRTA apparatus is an apparatus for heat treatment using a high-temperature gas. As the high-temperature gas, an inert gas which does not react with an object to be processed by heat treatment, such as nitrogen or a rare gas like argon, is used.

For example, as the first heat treatment, GRTA by which the substrate is moved into an inert gas heated to a temperature as high as 650° C. to 700° C., heated for several minutes, and moved out of the inert gas heated to the high temperature may be performed.

Note that in the first heat treatment, it is preferable that water, hydrogen, and the like be not contained in the atmosphere of nitrogen or a rare gas such as helium, neon, or argon. It is preferable that the purity of nitrogen or the rare gas such as helium, neon, or argon which is introduced into a heat treatment apparatus be set to 6N (99.9999%) or higher, preferably 7N (99.99999%) or higher (i.e., the impurity concentration is 1 ppm or lower, preferably 0.1 ppm or lower).

After the oxide semiconductor layer is heated in the first heat treatment, a high-purity oxygen gas, a high-purity $N_2O$ gas, or ultra-dry air (having a dew point lower than or equal to −40° C., preferably lower than or equal to −60° C.) may be introduced into the furnace. It is preferable that water, hydrogen, and the like be not contained in an oxygen gas or an $N_2O$ gas. The purity of the oxygen gas or the $N_2O$ gas which is introduced into the heat treatment apparatus is preferably 6N or higher, more preferably 7N or higher (i.e., the concentration of impurities in the oxygen gas or the $N_2O$ gas is preferably 1 ppm or lower, more preferably 0.1 ppm or lower). Oxygen which is a main component of the oxide semiconductor and has been reduced because of the step of removing impurities through the dehydration or the dehydrogenation is supplied with the use of the effect of the oxygen gas or the $N_2O$ gas, so that the oxide semiconductor layer can be purified to be i-type (intrinsic).

The first heat treatment of the oxide semiconductor layer may be performed on the oxide semiconductor film 530 which has not yet been processed into the island-shaped oxide semiconductor layer. In that case, the substrate is taken out of the heat apparatus after the first heat treatment, and then a photolithography process is performed.

Note that the first heat treatment may be performed at either of the following timings without limitation to the above timing as long as it is performed after the oxide semiconductor layer is formed: after a source electrode layer and a drain electrode layer are formed over the oxide semiconductor layer; and after an insulating layer is formed over the source electrode layer and the drain electrode layer.

Further, the step of forming the contact hole in the gate insulating layer 507 may be performed either before or after the first heat treatment is performed on the semiconductor film 530.

Alternatively, the oxide semiconductor layer may be formed through two separate film formation steps and two separate heat treatment steps. The thus formed oxide semiconductor layer has a thick crystalline region, that is, a crystalline region the c-axis of which is aligned in a direction perpendicular to a surface of the layer, even when any of an oxide, a nitride, a metal, and the like is used as a material for a base component. For example, a first oxide semiconductor film with a thickness greater than or equal to 3 nm and less than or equal to 15 nm is formed, and first heat treatment is performed in a nitrogen, oxygen, rare gas, or dry air atmosphere at 450° C. to 850° C., preferably 550° C. to 750° C., so that the first oxide semiconductor film has a crystalline region (including a plate-like crystal) in a region including its surface. Then, a second oxide semiconductor film which has a larger thickness than the first oxide semiconductor film is formed, and second heat treatment is performed at 450° C. to 850° C., preferably 600° C. to 700° C., so that crystal growth proceeds upward with the use of the first oxide semiconductor film as a seed of the crystal growth and the whole second oxide semiconductor film is crystallized. In such a manner, the oxide semiconductor layer having a thick crystalline region may be formed.

Next, a conductive film which serves as the source electrode layer and the drain electrode layer (including a wiring formed using the same layer as the source electrode layer and the drain electrode layer) is formed over the gate insulating layer 507 and the oxide semiconductor layer 531. As the conductive film which serves as the source electrode layer and the drain electrode layer, for example, a metal film including an element selected from Al, Cr, Cu, Ta, Ti, Mo, and W, or a metal nitride film including any of the above elements as its component (e.g., a titanium nitride film, a molybdenum nitride film, or a tungsten nitride film) can be used. Alternatively, a film of a high-melting-point metal such as Ti, Mo, or W or a metal nitride film (e.g., a titanium nitride film, a molybdenum nitride film, or a tungsten nitride film) may be formed over or/and below the metal film such as an Al film or a Cu film In particular, a conductive film containing titanium is preferably provided on the side in contact with the oxide semiconductor layer.

Figure 9C:
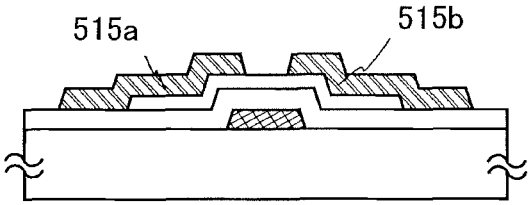

A resist mask is formed over the conductive film in a third photolithography step, and selective etching is performed to form the source electrode layer 515*a* and the drain electrode layer 515*b*, and then, the resist mask is removed (see FIG. 9C).

Light exposure at the time of the formation of the resist mask in the third photolithography step may be performed using ultraviolet light, KrF laser light, or ArF laser light. A channel length (L) of a transistor that is completed later is determined by a distance between bottom ends of the source electrode layer and the drain electrode layer, which are adjacent to each other over the oxide semiconductor layer 531. In the case where light exposure is performed for a channel length (L) of less than 25 nm, the light exposure at the time of the formation of the resist mask in the third photolithography step may be performed using extreme ultraviolet light having an extremely short wavelength of several nanometers to several tens of nanometers. In the light exposure by extreme ultraviolet light, the resolution is high and the focus depth is large. Thus, the channel length (L) of the transistor to be formed later can be greater than or equal to 10 nm and less than or equal to 1000 nm, and the circuit can operate at higher speed.

In order to reduce the number of photomasks and the number of steps in photolithography, an etching step may be performed with the use of a resist mask formed with the use of a multi-tone mask which is a light-exposure mask through which light is transmitted to have a plurality of intensities. A resist mask formed with the use of a multi-tone mask has a plurality of thicknesses and further can be changed in shape by being etched; thus, the resist mask can be used in a plurality of etching steps for forming different patterns. Thus, a resist mask corresponding to at least two kinds of different patterns can be formed by one multi-tone mask. Therefore, the number of light-exposure masks can be reduced and the number of corresponding photolithography steps can also be reduced, resulting in simplification of a process.

Note that it is preferable that etching conditions be optimized so as not to etch and divide the oxide semiconductor layer 531 when the conductive film is etched. However, it is difficult to obtain conditions under which only the conductive film is etched and the oxide semiconductor layer 531 is not etched at all. For that reason, in some cases, only part of the oxide semiconductor layer 531 is etched to be an oxide semiconductor layer having a groove (a depressed portion) at the time when the conductive film is etched.

In this embodiment, since a Ti film is used as the conductive film and an In—Ga—Zn—O-based oxide semiconductor is used for the oxide semiconductor layer 531, an ammonia hydrogen peroxide mixture (a mixed solution of ammonia, water, and a hydrogen peroxide solution) is used as an etchant.

Next, by plasma treatment using a gas such as $N_2O$, $N_2$, or Ar, water or the like adsorbed to a surface of an exposed portion of the oxide semiconductor layer may be removed. In the case where the plasma treatment is performed, the insulating layer 516 which serves as a protective insulating film in contact with part of the oxide semiconductor layer is formed without being exposed to the air.

The insulating layer 516 can be formed to a thickness of at least 1 nm by a method in which impurities such as water and hydrogen do not enter the insulating layer 516, such as a sputtering method. When hydrogen is contained in the insulating layer 516, entry of hydrogen to the oxide semiconductor layer or extraction of oxygen in the oxide semiconductor layer by hydrogen may occur, thereby causing a backchannel of the oxide semiconductor layer to have lower resistance (to be n-type), so that a parasitic channel may be formed. Therefore, it is important that a formation method in which hydrogen is not used be employed so that the insulating layer 516 contains hydrogen as little as possible.

In this embodiment, as the insulating layer 516, a silicon oxide film is formed to a thickness of 200 nm by a sputtering method. The substrate temperature in film formation may be higher than or equal to room temperature and lower than or equal to 300° C. and is 100° C. in this embodiment. The silicon oxide film can be formed by a sputtering method in a rare gas (typically, argon) atmosphere, an oxygen atmosphere, or a mixed atmosphere of a rare gas and oxygen. As a target, a silicon oxide target or a silicon target may be used. For example, the silicon oxide film can be formed using a silicon target by a sputtering method in an atmosphere containing oxygen. As the insulating layer 516 which is formed in contact with the oxide semiconductor layer, an inorganic insulating film which does not contain impurities such as moisture, a hydrogen ion, and $OH^-$ and blocks the entry of these impurities from the outside is used. Typically, a silicon oxide film, a silicon oxynitride film, an aluminum oxide film, an aluminum oxynitride film, or the like is used. As in the case of forming the oxide semiconductor film 530, an entrapment vacuum pump (e.g., a cryopump) is preferably used in order to remove moisture remaining in a deposition chamber used for forming the insulating layer 516. The insulating layer 516 is formed in a deposition chamber in which evacuation has been performed with a cryopump, whereby the concentration of impurities in the insulating layer 516 can be reduced. A turbo pump provided with a cold trap may be used as an evacuation unit for removing moisture remaining in the deposition chamber used for forming the insulating layer 516.

It is preferable that a high-purity gas from which impurities such as hydrogen, water, hydroxyl group, or hydride have been removed be used as a sputtering gas for the formation of the insulating layer 516.

Next, second heat treatment (preferably at 200° C. to 400° C., for example, at 250° C. to 350° C.) is performed in an inert gas atmosphere or an oxygen gas atmosphere. For example, the second heat treatment is performed in a nitrogen atmosphere at 250° C. for one hour. In the second heat treatment, part of the oxide semiconductor layer (a channel formation region) is heated while being in contact with the insulating layer 516.

As described above, the first heat treatment is performed on the oxide semiconductor film, whereby impurities such as hydrogen, moisture, hydroxyl group, or hydride (also referred to as a hydrogen compound) can be intentionally eliminated from the oxide semiconductor layer and oxygen, which is one of main components of the oxide semiconductor but has been reduced through the step of eliminating the impurities, can be supplied. Through the above steps, the oxide semiconductor layer is purified and is made to be an i-type (intrinsic) semiconductor.

Figure 9D:
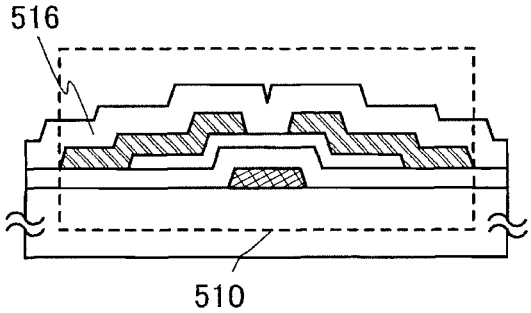
Figure 9E:
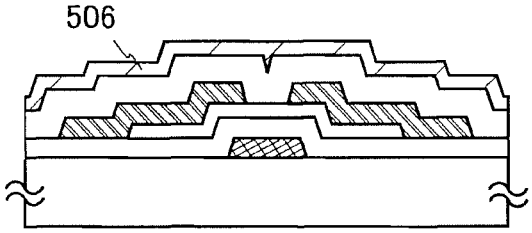

Through the above steps, the transistor 510 is formed (FIG. 9D).

When a silicon oxide layer having a lot of defects is used as the insulating layer 516, heat treatment after formation of the silicon oxide layer has an effect in diffusing impurities such as hydrogen, moisture, a hydroxyl group, or hydride contained in the oxide semiconductor layer to the oxide insulating layer so that the impurity contained in the oxide semiconductor layer can be further reduced.

A protective insulating layer 506 may be additionally formed over the insulating layer 516. As the protective insulating layer 506, for example, a silicon nitride film is formed by an RF sputtering method. An RF sputtering method has high productivity, and thus is preferably used as a formation method of the protective insulating layer. As the protective insulating layer, an inorganic insulating film which does not contain impurities such as moisture and blocks entry of the impurities from the outside is used; for example, a silicon nitride film, an aluminum nitride film, or the like is used. In this embodiment, the protective insulating layer 506 is formed using a silicon nitride film (see FIG. 9E).

In this embodiment, as the protective insulating layer 506, a silicon nitride film is formed by heating the substrate 505 over which layers up to the insulating layer 516 are formed, to a temperature of 100° C. to 400° C., introducing a sputtering gas containing high-purity nitrogen from which hydrogen and moisture are removed, and using a target of silicon semiconductor. In this step also, the protective insulating layer 506 is preferably formed while moisture remaining in the deposition chamber is removed as in the case of the formation of the insulating layer 516.

After the protective insulating layer is formed, heat treatment may be further performed at a temperature greater than or equal to 100° C. and less than or equal to 200° C. for 1 hour to 30 hours in the air. This heat treatment may be performed at a fixed heating temperature. Alternatively, the following change in the heating temperature may be conducted plural times repeatedly: the heating temperature is raised from room temperature to a temperature higher than or equal to 100° C. and lower than or equal to 200° C. and then decreased to room temperature.

In the transistor described as example in this example, current flowing between the source electrode and the drain electrode when the transistor is off is extremely small. Thus, by using the transistor as a pixel transistor of a liquid crystal display panel, deterioration of image data written to a pixel in an image holding period can be suppressed. Thus, the image holding period can be lengthened and the frequency of image writing can be reduced. Thus, power consumption can be reduced by using the liquid crystal display panel in which the transistor described as an example in this embodiment is used. Further, a fixed potential is supplied from the capacitor in the backup circuit in the image holding period, so that the DC-DC converter can be stopped and furthermore electric charge charged in the capacitor through the transistor described as an example in this embodiment does not leak; thus, power consumption can be further reduced.

Note that this embodiment can be combined with any of the other embodiments described in this specification as appropriate.

EXAMPLE

In this example, results of manufacturing a liquid crystal display device which includes a liquid crystal display panel driven by power supplied from a DC-DC converter or a backup circuit and writing still images at different frequencies will be described.

Figure 10:
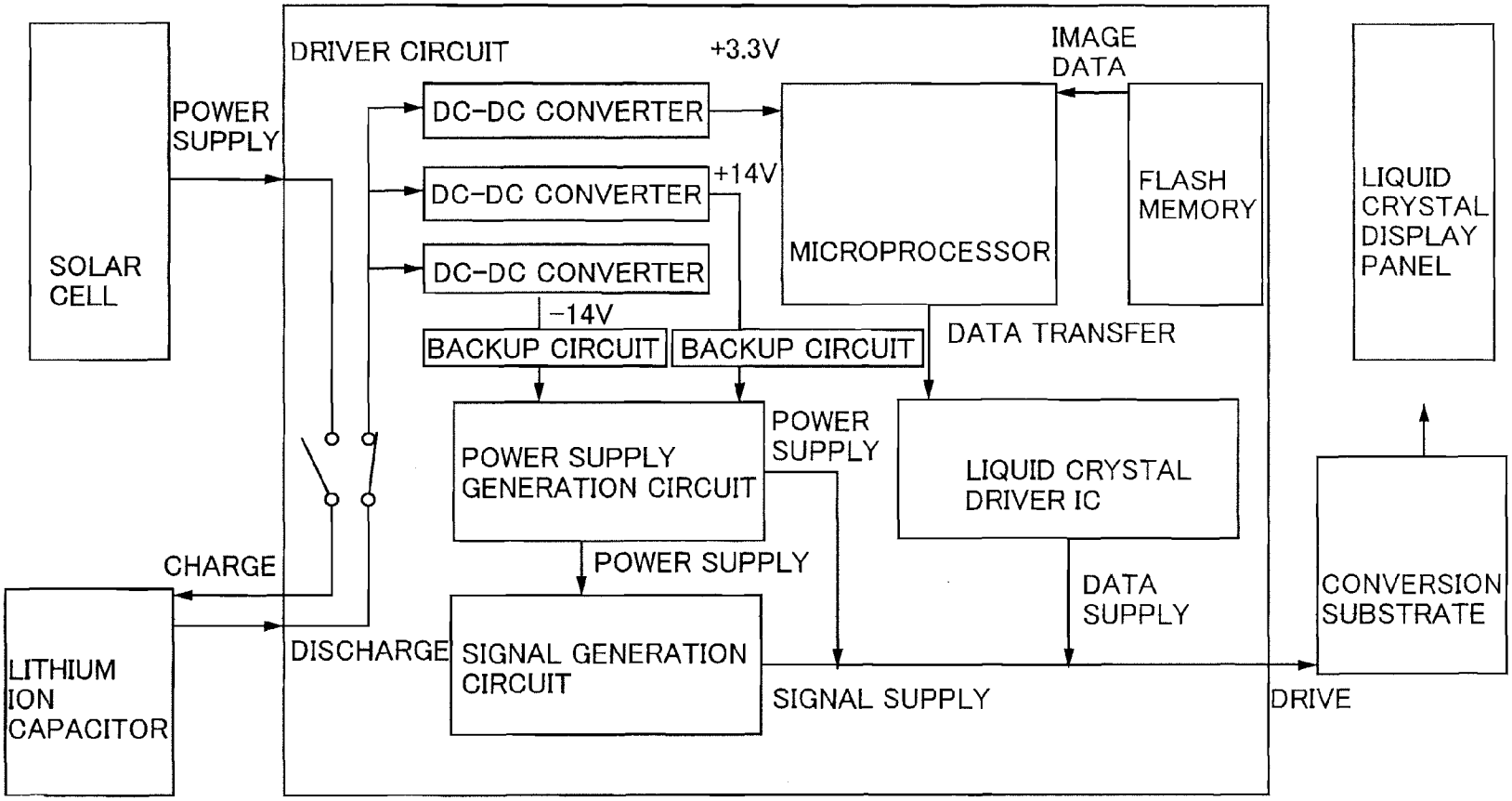
FIG. 10 is a block diagram illustrating a structure of a liquid crystal display device according to Example.

A structure of a liquid crystal display device which is described as an example in this example will be described with reference to the block diagram of FIG. 10. The liquid crystal display device has a solar cell, a lithium ion capacitor, a driver circuit, a conversion substrate, and a liquid crystal display panel.

The driver circuit includes a DC-DC converter which outputs +3.3 V to a microprocessor, a DC-DC converter which outputs +14 V to a power supply generation circuit through a backup circuit, and a DC-DC converter which outputs −14 V to the power supply generation circuit through a backup circuit. The power supply circuit supplies power supply to a signal generation circuit and supplies power supply to the liquid crystal display panel through the conversion substrate.

The microprocessor reads image data from a flash memory and transmits the data to a liquid crystal driver IC. The liquid crystal driver IC supplies the image data to the liquid crystal display panel through the conversion substrate. The solar cell charges the lithium ion capacitor by supplying power. The lithium ion capacitor supplies power to the driver circuit. The driver circuit drives the liquid crystal display panel with the use of the conversion substrate.

Figure 11:
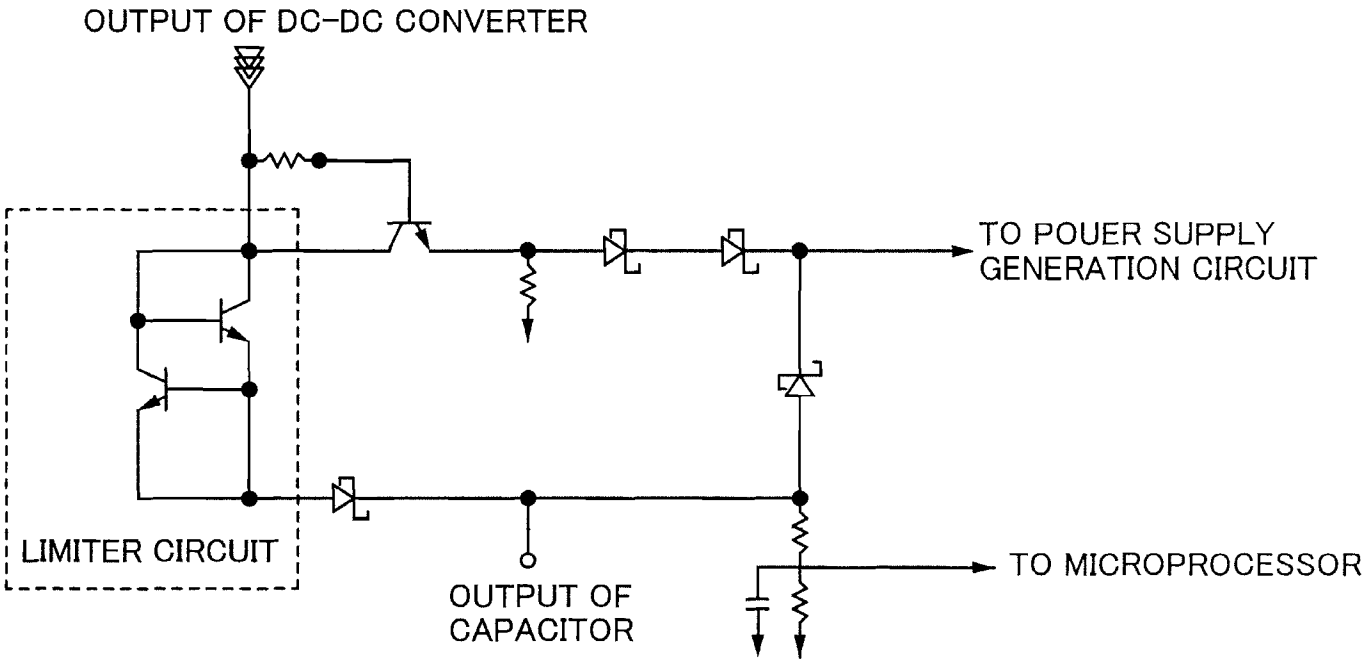
FIG. 11 is a circuit diagram illustrating a configuration of a backup circuit according to Example.

A configuration of the backup circuit included in the liquid crystal display device described as an example in this example is illustrated in FIG. 11. The backup circuit includes a first circuit in which power output from the DC-DC converter reaches the power supply generation circuit through rectifier elements and a second circuit in which power output from the DC-DC converter reaches the power supply generation circuit through a limiter circuit and two rectifier elements. A capacitor is connected between the two rectifier elements of the second circuit. The microprocessor monitors the potential of the capacitor.

The time for which the liquid crystal display device with the above structure can be driven with the use of the lithium ion capacitor was measured. Note that the measurement was performed in such a manner that a lithium ion capacitor capable of storing power of 4.1 mAh was used and the time it takes for the initial value of the output voltage of the lithium ion capacitor to decrease to 3.5 V from 4 V was regarded as time for which the liquid crystal display device can be driven. In addition, the potential of the capacitor was monitored every two seconds.

Figure 12:
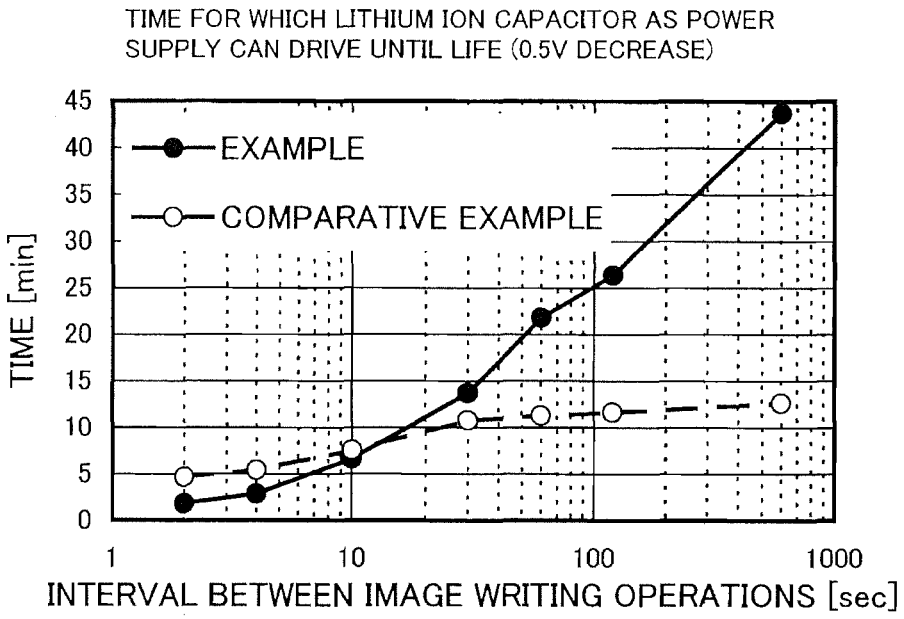
FIG. 12 shows relationship between the image holding time and the time for which a liquid crystal display device according to Example can be driven.

In FIG. 12, results of plotting the time for which the lithium ion can drive the liquid crystal display device with respect to the intervals between image writing operations are indicated by a solid line. When the interval between the image writing operations was increased from 10 seconds to 600 seconds, the time for which the liquid crystal display device of this example could be driven was approximately 6.7 times longer. The time for which the liquid crystal display device of this example could be driven greatly depended on the interval between the image writing operations, the DC-DC converter was stopped in a period in which a still image was held, and an effect of reducing power consumption was obtained.

Comparative Example

The time for which a liquid crystal display device in which the backup circuit of the liquid crystal display device described in Example is not provided can be driven with the use of the lithium ion capacitor described 1 was measured. Note that two converters were connected so that potentials were directly output to the power supply generation circuit and the output potentials of the converters were set at +13 V and −13 V.

In FIG. 12, results of plotting the time for which the lithium ion can drive the liquid crystal display device with respect to the intervals between image writing operations are indicated by a dashed line. When the interval between the image writing operations was increased from 10 seconds to 600 seconds, the time for which the liquid crystal display device of this comparative example could be driven was approximately 1.7 times longer.

The time for which the liquid crystal display device of Example including the backup circuit could be driven was 3.46 times as long as that for which the liquid crystal display device of this comparative example could be driven.

This application is based on Japanese Patent Application serial no. 2010-100365 filed with the Japan Patent Office on Apr. 23, 2010, the entire contents of which are hereby incorporated by reference.

EXPLANATION OF REFERENCE

100: liquid crystal display device, 110: driver circuit portion, 112: switching circuit, 113: display control circuit, 114: arithmetic circuit, 115*a*: signal generation circuit, 115*b*:

liquid crystal driver circuit, 116: power supply circuit, 117: power supply potential generation circuit, 118*a*: DC-DC converter, 118*b*: DC-DC converter, 118*c*: DC-DC converter, 119*a*: backup circuit, 119*b*: backup circuit, 120: liquid crystal display panel, 121: pixel driver circuit portion, 121A: gate line driver circuit, 121B: source line driver circuit, 122: pixel portion, 123: pixel, 124: gate line, 125: source line, 126: terminal portion, 126A: terminal, 126B: terminal, 127: switching element, 128: common electrode, 130: backlight portion, 131: backlight control circuit, 132: backlight, 140: memory device, 150: power supply portion, 151: secondary battery, 155: solar cell, 160: input device, 190*a*: first switch, 190*b*: first switch, 191*a*: first limiter circuit, 192*a*: capacitor, 192*b*: capacitor, 193*a*: second switch, 193*b*: second switch, 194*a*: third switch, 194*b*: third switch, 195*a*: terminal, 195*b*: terminal, 210: pixel, 214: transistor, 215: liquid crystal element, 505: substrate, 506: protective insulating layer, 507: gate insulating layer, 510: transistor, 511: gate electrode layer, 515*a*: source electrode layer, 515*b*: drain electrode layer, 516: insulating layer, 530: oxide semiconductor film, 531: oxide semiconductor layer, 601: period, 602: period, 603: period, 604: period, 1401: period, 1402: period, 1403: period, and 1404: period.

The invention claimed is:

1. A liquid crystal display device comprising:

a converter configured to convert a power supply into predetermined direct-current power;

a backup circuit comprising:

a capacitor;

an input terminal;

an output terminal;

a first switch;

a second switch; and a third switch;

a liquid crystal display panel; and a circuit configured to control the power supply to the converter, wherein the input terminal of the backup circuit is electrically connected to the output terminal of the converter, wherein the input terminal of the backup circuit is electrically connected to the output terminal of the backup circuit through the first switch, wherein the second switch, a terminal of the capacitor and the third switch are connected in series and in this order to each other, and in parallel with the first switch, wherein the backup circuit is configured such that, when the power supply is not input to the converter, the first switch and the second switch are off, and the third switch is on, and wherein the backup circuit is configured such that, when the power supply is input to the converter, the first switch and the second switch are on, and the third switch is off.

2. The liquid crystal display device according to claim 1, wherein same image signals are written to the liquid crystal display panel at intervals longer than or equal to 10 seconds and shorter than or equal to 600 seconds.

3. The liquid crystal display device according to claim 1, further comprising:

a pixel electrode;

a common electrode; and a liquid crystal provided between the pixel electrode and the common electrode, wherein the liquid crystal display device is configured so that a common potential can be supplied to the common electrode by the converter when the power supply is input to the converter.

4. The liquid crystal display device according to claim 1, wherein the means is further configured to disconnect the converter from the liquid crystal display panel when the power supply is not input to the converter, and wherein the means is configured to connect the converter to the capacitor and the liquid crystal display panel when the power supply is input to the converter.

5. The liquid crystal display device according to claim 4, wherein the liquid crystal display device is configured to input the power supply to the converter during an image writing period, and wherein the liquid crystal display device is configured to stop input of the power supply to the converter during an image holding period.

6. The liquid crystal display device according to claim 3, wherein the common potential is supplied to the common electrode by using power stored in the capacitor when input of the power supply to the converter is stopped.

7. A liquid crystal display device comprising:

a converter configured to convert a power supply into predetermined direct-current power;

a limiter circuit;

a backup circuit comprising:

a capacitor;

an input terminal;

an output terminal;

a first switch;

a second switch; and a third switch;

a liquid crystal display panel;

a circuit configured to control the power supply to the converter, wherein the input terminal of the backup circuit is electrically connected to the output terminal of the converter through the limiter circuit, wherein the input terminal of the backup circuit is electrically connected to the output terminal of the backup circuit through the first switch, wherein the second switch, a terminal of the capacitor and the third switch are connected in series and in this order to each other, and in parallel with the first switch, wherein the backup circuit is configured such that, when the power supply is not input to the converter, the first switch and the second switch are off, and the third switch is on, and wherein the backup circuit is configured such that, when the power supply is input to the converter, the first switch and the second switch are on, and the third switch is off.

8. The liquid crystal display device according to claim 7, wherein same image signals are written to the liquid crystal display panel at intervals longer than or equal to 10 seconds and shorter than or equal to 600 seconds.

9. The liquid crystal display device according to claim 7, further comprising:

a pixel electrode;

a common electrode; and a liquid crystal provided between the pixel electrode and the common electrode, wherein the liquid crystal display device is configured so that a common potential can be supplied to the common electrode by the converter when the power supply is input to the converter.

10. The liquid crystal display device according to claim 7, wherein the means is further configured to disconnect the converter from the liquid crystal display panel when the power supply is not input to the converter, and wherein the means is configured to connect the converter to the capacitor and the liquid crystal display panel when the power supply is input to the converter.

11. The liquid crystal display device according to claim 10, wherein the liquid crystal display device is configured to input the power supply to the converter during an image writing period, and wherein the liquid crystal display device is configured to stop input of the power supply to the converter during an image holding period.

12. The liquid crystal di splay device according to claim 9, wherein the common potential is supplied to the common electrode by using power stored in the capacitor when input of the power supply to the converter is stopped.

13. A method for driving a liquid crystal display device comprising:

charging a capacitor provided in a backup circuit and writing an image to a liquid crystal display panel, by using power supplied through a converter configured to convert a power supply into predetermined direct-current power;

monitoring a potential of the capacitor provided in the backup circuit and determining whether the potential of the capacitor is higher than a first value; and stopping the power supply to the converter when it is determined that the potential of the capacitor is higher than the first value, wherein timing of connection of the capacitor to the liquid crystal display panel is synchronized with timing of stopping the power supply to the converter.

14. The method for driving the liquid crystal display device according to claim 13, wherein the liquid crystal display device comprises:

a pixel electrode;

a common electrode; and a liquid crystal provided between the pixel electrode and the common electrode, wherein a common potential is supplied to the common electrode by the converter when the power supply is input to the converter.

15. The method for driving the liquid crystal display device according to claim 14, further comprising:

stopping power supply to the converter in a still image display mode; and supplying the common potential to the common electrode by using power stored in the capacitor in the still image display mode.

16. The method for driving the liquid crystal display device according to claim 15, wherein the common potential is a fixed potential serving as a reference with respect to a potential of an image signal supplied to the pixel electrode.

17. The method for driving the liquid crystal display device according to claim 13, further comprising:

monitoring a gate potential of a pixel transistor of the liquid crystal display panel;

starting the power supply to the converter when an absolute value of the gate potential of the pixel transistor is smaller than a second value; and repeating the monitoring operation until set time or an interrupt instruction.

18. The method for driving the liquid crystal display device according to claim 17, wherein the second value is greater than or equal to 5V.

19. The method for driving the liquid crystal display device according to claim 13, wherein the first value is less than or equal to 98% of an output potential of the converter.

20. The liquid crystal display device according to claim 1, wherein the liquid crystal display panel comprises a pixel transistor including an oxide semiconductor layer, wherein the oxide semiconductor layer contains indium, gallium, and zinc.

21. The liquid crystal display device according to claim 7, wherein the liquid crystal display panel comprises a pixel transistor including an oxide semiconductor layer, wherein the oxide semiconductor layer contains indium, gallium, and zinc.

22. The method for driving the liquid crystal display device according to claim 13, wherein the liquid crystal display panel comprises a pixel transistor including an oxide semiconductor layer, and wherein the oxide semiconductor layer contains indium, gallium, and zinc.

* * * * *